US009293103B2

(12) United States Patent
Saitoh et al.

(10) Patent No.: US 9,293,103 B2
(45) Date of Patent: Mar. 22, 2016

(54) DISPLAY DEVICE, AND METHOD FOR DRIVING SAME

(75) Inventors: Kohji Saitoh, Osaka (JP); Asahi Yamato, Osaka (JP); Masami Ozaki, Osaka (JP); Toshihiro Yanagi, Osaka (JP); Masakazu Wada, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/009,340

(22) PCT Filed: Apr. 3, 2012

(86) PCT No.: PCT/JP2012/059035

§ 371 (c)(1),
(2), (4) Date: Oct. 2, 2013

(87) PCT Pub. No.: WO2012/137756

PCT Pub. Date: Oct. 11, 2012

(65) Prior Publication Data

US 2014/0028646 A1 Jan. 30, 2014

(30) Foreign Application Priority Data

Apr. 7, 2011 (JP) ..... 2011-085812

(51) Int. Cl.
*G09G 3/36* (2006.01)

(52) U.S. Cl.
CPC ..... *G09G 3/3674* (2013.01); *G09G 3/3614* (2013.01); *G09G 3/3648* (2013.01); *G09G 2310/08* (2013.01); *G09G 2320/0219* (2013.01); *G09G 2330/021* (2013.01)

(58) Field of Classification Search
CPC ..... G09G 3/33648; G09G 3/33688; G09G 2310/061
USPC ..... 345/94, 96, 99, 209, 545
See application file for complete search history.

(56) References Cited

U.S. PATENT DOCUMENTS

| | | | | |
|---|---|---|---|---|
| 2002/0041281 | A1* | 4/2002 | Yanagi et al. | 345/212 |
| 2002/0180673 | A1* | 12/2002 | Tsuda et al. | 345/87 |
| 2004/0145551 | A1* | 7/2004 | Tobita | 345/87 |
| 2004/0233228 | A1* | 11/2004 | Ota | 345/690 |
| 2005/0104831 | A1 | 5/2005 | Hoshino | |
| 2006/0007092 | A1* | 1/2006 | Sekiguchi et al. | 345/92 |
| 2006/0103637 | A1* | 5/2006 | Yamaguchi et al. | 345/175 |
| 2007/0273683 | A1* | 11/2007 | Yamada | 345/212 |

(Continued)

FOREIGN PATENT DOCUMENTS

| | | | |
|---|---|---|---|
| JP | 2001-312253 | A | 11/2001 |
| JP | 2005-148362 | A | 6/2005 |

(Continued)

OTHER PUBLICATIONS

Official Communication issued in International Patent Application No. PCT/JP2012/059035, mailed on May 15, 2012.

*Primary Examiner* — Ricardo L Osorio
(74) *Attorney, Agent, or Firm* — Keating & Bennett, LLP

(57) ABSTRACT

A display device including a display panel and repeating a scanning period during which the display panel is scanned and a pause period during which the display panel is not scanned. A scanning period and a pause period are set successively to a preceding frame out of two consecutive frames. A pause period is set to an entire period of a subsequent frame out of the two consecutive frames.

20 Claims, 17 Drawing Sheets

(56) References Cited

U.S. PATENT DOCUMENTS

| | | | | |
|---|---|---|---|---|
| 2008/0055218 | A1 | 3/2008 | Tsuda et al. | |
| 2008/0297500 | A1 | 12/2008 | Kato | |
| 2009/0122172 | A1* | 5/2009 | Iwata et al. | 348/302 |
| 2010/0065840 | A1 | 3/2010 | Yamazaki et al. | |
| 2010/0073341 | A1* | 3/2010 | Toyooka et al. | 345/208 |
| 2010/0103156 | A1* | 4/2010 | Yamashita et al. | 345/211 |
| 2010/0277463 | A1* | 11/2010 | Yen et al. | 345/213 |
| 2011/0175883 | A1* | 7/2011 | Toyotaka et al. | 345/211 |
| 2011/0180794 | A1* | 7/2011 | Yamazaki | 257/43 |
| 2011/0181560 | A1* | 7/2011 | Yamazaki | 345/204 |
| 2013/0009935 | A1* | 1/2013 | Yanagi et al. | 345/211 |
| 2013/0050146 | A1* | 2/2013 | Saitoh et al. | 345/174 |
| 2013/0314360 | A1* | 11/2013 | Saitoh et al. | 345/173 |
| 2014/0191989 | A1* | 7/2014 | Saitoh et al. | 345/173 |

FOREIGN PATENT DOCUMENTS

| | | | |
|---|---|---|---|
| JP | 2008-298997 | A | 12/2008 |
| JP | 2010-092036 | A | 4/2010 |

* cited by examiner

DISPLAY DEVICE, AND METHOD FOR DRIVING SAME

TECHNICAL FIELD

The present invention relates to a display device which enables reducing electric power consumption, and a method for driving the display device.

BACKGROUND ART

In recent years, display devices have been widely used which are thin, lightweight, and low in electric power consumption, and are typified by liquid crystal display devices. Such display devices are particularly provided to, for example, a mobile phone, a smart phone, a laptop personal computer, or the like. Further, electronic paper, which is a thinner display device, is expected to be rapidly developed and widespread in the future. Under such circumstances, a reduction in electric power consumption in various kinds of display devices is a common object at present.

Patent Literature 1 discloses a method for driving a display device in which method low electric power consumption is realized by providing a pause period during which no scanning signal lines are scanned. FIG. 16 is a timing diagram showing a vertical sync signal, an operating state, and a waveform of a power supply current of the display device described in Patent Literature 1. Note that in Patent Literature 1, a single scanning period and a single pause period are set to a single frame, whereas in FIG. 16, a scanning period is set to one of two consecutive frames, and a pause period is set to the other of the two consecutive frames.

As shown in FIG. 16, the display device is configured such that, with respect to two consecutive frames, for example, a frame between $t_{16_1}$ and $t_{16_2}$ and a frame between $t_{16_2}$ and $t_{16_3}$, the former frame is set as a scanning period during which the display device is in a 'scanning' operating state, whereas the latter frame is set as a pause period during which the display device is in a 'pause' operating state. That is, the frame between $t_{16_1}$ and $t_{16_2}$ is set as a scanning frame, and the frame between $t_{16_2}$ and $t_{16_3}$ is set as a pause frame. Likewise, the frame between $t_{16_3}$ and $t_{16_4}$ is set as a scanning frame, and the frame between $t_{16_4}$ and $t_{16_5}$ is set as a pause frame.

In the display device described in Patent Literature 1, provision of these pause frames causes a reduction in value $I_{161}$ of an average consumed electric current relative to a ground potential GND. As described above, a single pause period is set to a single frame. In the pause frame, generation of a stationary electric current (self-consumed electric current), which is consumed by drive circuits for driving scanning lines and signal lines of the display panel, a power supply circuit for supplying electric power to the drive circuits, and the like, is stopped. The period during which the generation of the stationary electric current is stopped, i.e., a pause period, corresponds to a single frame and is long enough to reduce the value $I_{162}$ of the self-consumed electric current. The reduction in value $I_{162}$ of the self-consumed electric current in the pause frame allows reducing the electric power consumption of the display device.

CITATION LIST

Patent Literature

Patent Literature 1
Japanese Patent Application Publication, Tokukai, No. 2001-312253 A (Publication Date: Nov. 9, 2001)

SUMMARY OF INVENTION

Technical Problem

According to the display device described in Patent Literature 1, it is certainly possible to reduce the electric power consumption of the display device by reducing the value $I_{162}$ of the self-consumed electric current during pause periods by setting a single pause period to a single frame.

Note, here, that in the display device, a single scanning period is also set to a single frame, similarly as the pause period. This means that there is room for further reduction in consumed electric current in each scanning period. This is because shortening a scanning period allows a reduction in self-consumed electric current in the scanning period, and thus allows a further reduction in the electric power consumption of the display device.

Further, shortening a scanning period provides another effect that a period until the next polarity reversal occurs becomes longer, so that the possibility that the user recognizes a luminance gradient on the display panel can be reduced.

However, Patent Literature 1 does not disclose anything about the shortening of a scanning period.

In view of the above problem, an object of the present invention is to provide a display device which repeats a scanning period and a pause period and can reduce electric power consumption, and a method for driving the display device.

Solution to Problem

A display device according to the present invention is a display device including a display panel, the display device repeating a scanning period during which the display panel is scanned and a pause period during which the display panel is not scanned, wherein: a scanning period and a pause period are set successively to a preceding frame out of two consecutive frames; and a pause period is set to an entire period of a subsequent frame out of the two consecutive frames.

According to this, a ratio of a pause period to a scanning period in an entire period of two consecutive frames is increased. This makes it possible to effectively suppress generation of a self-consumed electric current which is consumed by a scanning line drive circuit for driving a scanning signal line of the display panel, a signal line drive circuit for driving a data signal line of the display panel, a power supply circuit for supplying electric power to the scanning line drive circuit and the signal line drive circuit, and the like. That is, a reduction in value of the self-consumed electric current in the pause period, which is sufficiently long, allows a reduction in value of an average consumed electric current in the scanning line drive circuit, the signal line drive circuit, and the like.

This makes it possible to reduce electric power consumption of the display device.

Further, conversely, a ratio of a scanning period to a pause period in the entire period of the two consecutive frames can be significantly reduced. This makes it possible to prevent degradation of display quality caused by generation of a luminance gradient.

A display device according to the present invention is a display device including a display panel, the display device repeating a scanning period during which the display panel is scanned and a pause period during which the display panel is not scanned, wherein: a pause period is set to an entire period of a preceding frame out of two consecutive frames; and a pause period and a scanning period are set successively to a subsequent frame out of the two consecutive frames.

According to this, a ratio of a pause period to a scanning period in an entire period of two consecutive frames is increased. This makes it possible to effectively suppress generation of a self-consumed electric current which is consumed by a scanning line drive circuit for driving a scanning signal line of the display panel, a signal line drive circuit for driving a data signal line of the display panel, a power supply circuit for supplying electric power to the scanning line drive circuit and the signal line drive circuit, and the like. That is, a reduction in value of the self-consumed electric current in the pause period, which is sufficiently long, allows a reduction in value of an average consumed electric current in the scanning line drive circuit, the signal line drive circuit, and the like.

This makes it possible to reduce electric power consumption of the display device.

A method, according to the present invention, for driving a display device is a method for driving a display device which includes a display panel and repeats a scanning period during which the display panel is scanned and a pause period during which the display panel is not scanned, the method including: setting a scanning period and a pause period successively to a preceding frame out of two consecutive frames; and setting a pause period to an entire period of a subsequent frame out of the two consecutive frames.

According to this, a ratio of a pause period to a scanning period in an entire period of two consecutive frames is increased. This makes it possible to effectively stop generation of a self-consumed electric current which is consumed by a scanning line drive circuit for driving a scanning signal line of the display panel, a signal line drive circuit for driving a data signal line of the display panel, a power supply circuit for supplying electric power to the scanning line drive circuit and the signal line drive circuit, and the like.

A reduction in value of the self-consumed electric current in the pause period, which is sufficiently long, allows a reduction in value of an average consumed electric current in the scanning line drive circuit, the signal line drive circuit, and the like.

This makes it possible to reduce electric power consumption of the display device.

Further, conversely, a ratio of a scanning period to a pause period in the entire period of the two consecutive frames can be significantly reduced as compared with the display device described in Patent Literature 1 and the above-described reference configuration. This makes it possible to prevent degradation of display quality caused by generation of a luminance gradient.

A method, according to the present invention, for driving a display device is a method for driving a display device which includes a display panel and repeats a scanning period during which the display panel is scanned and a pause period during which the display panel is not scanned, the method including: setting a pause period to an entire period of a preceding frame out of two consecutive frames; and setting a scanning period and a pause period successively to a subsequent frame out of the two consecutive frames.

According to this, a ratio of a pause period to a scanning period in an entire period of two consecutive frames is increased. This makes it possible to effectively suppress generation of a self-consumed electric current which is consumed by a scanning line drive circuit for driving a scanning signal line of the display panel, a signal line drive circuit for driving a data signal line of the display panel, a power supply circuit for supplying electric power to the scanning line drive circuit and the signal line drive circuit, and the like. That is, a reduction in value of the self-consumed electric current in the pause period, which is sufficiently long, allows a reduction in value of an average consumed electric current in the scanning line drive circuit, the signal line drive circuit, and the like.

This makes it possible to reduce electric power consumption of the display device.

Advantageous Effects of Invention

A display device according to the present invention is a display device including a display panel, the display device repeating a scanning period during which the display panel is scanned and a pause period during which the display panel is not scanned, wherein: a scanning period and a pause period are set successively to a preceding frame out of two consecutive frames; and a pause period is set to an entire period of a subsequent frame out of the two consecutive frames.

This makes it possible to reduce electric power consumption by setting a scanning period and a pause period to two consecutive frames so that the scanning period is shorter than the pause period.

Figure 14:
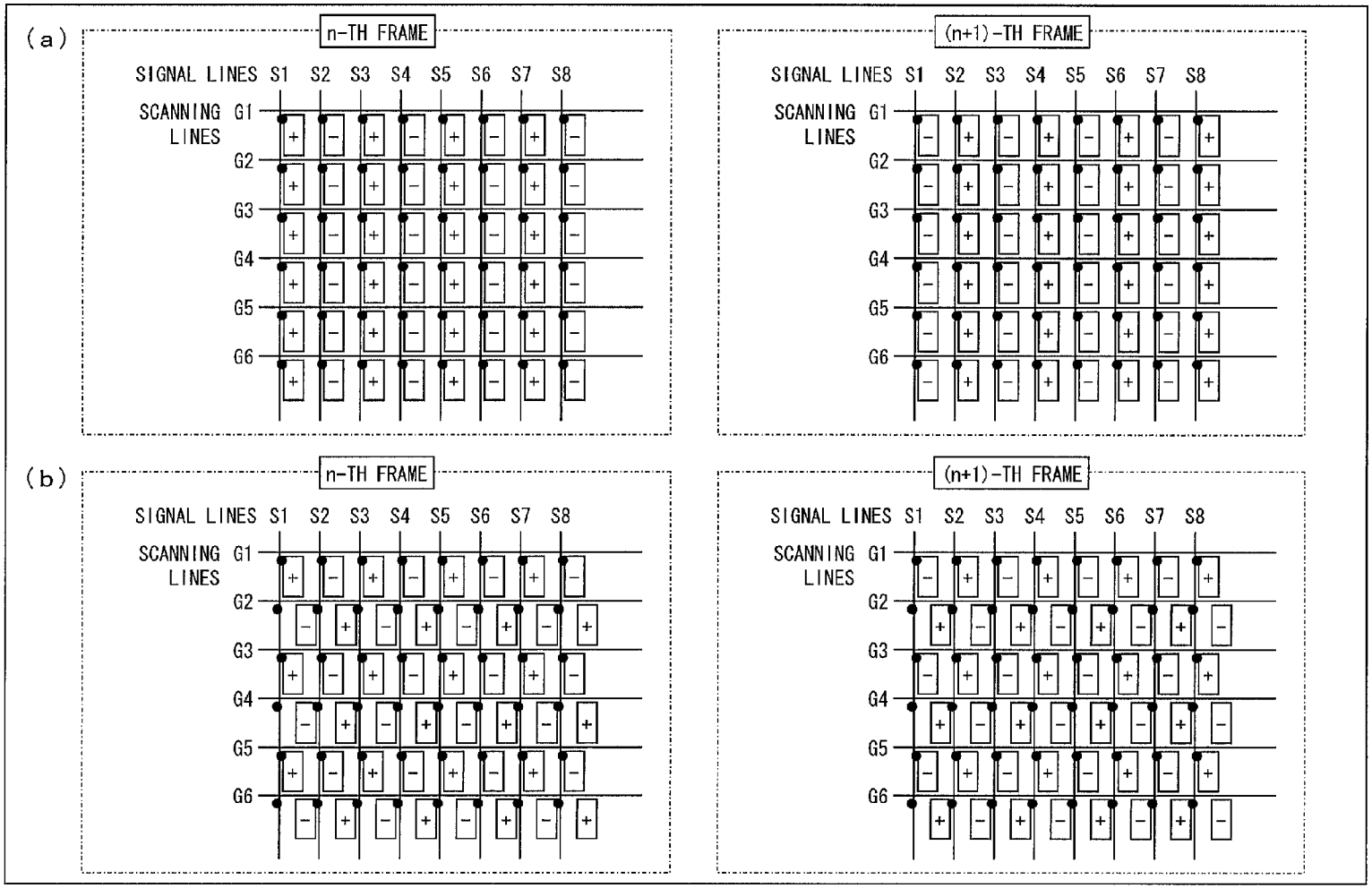

(a) and (b) of FIG. 14 are explanatory views illustrating how a display panel is driven.

Figure 15:
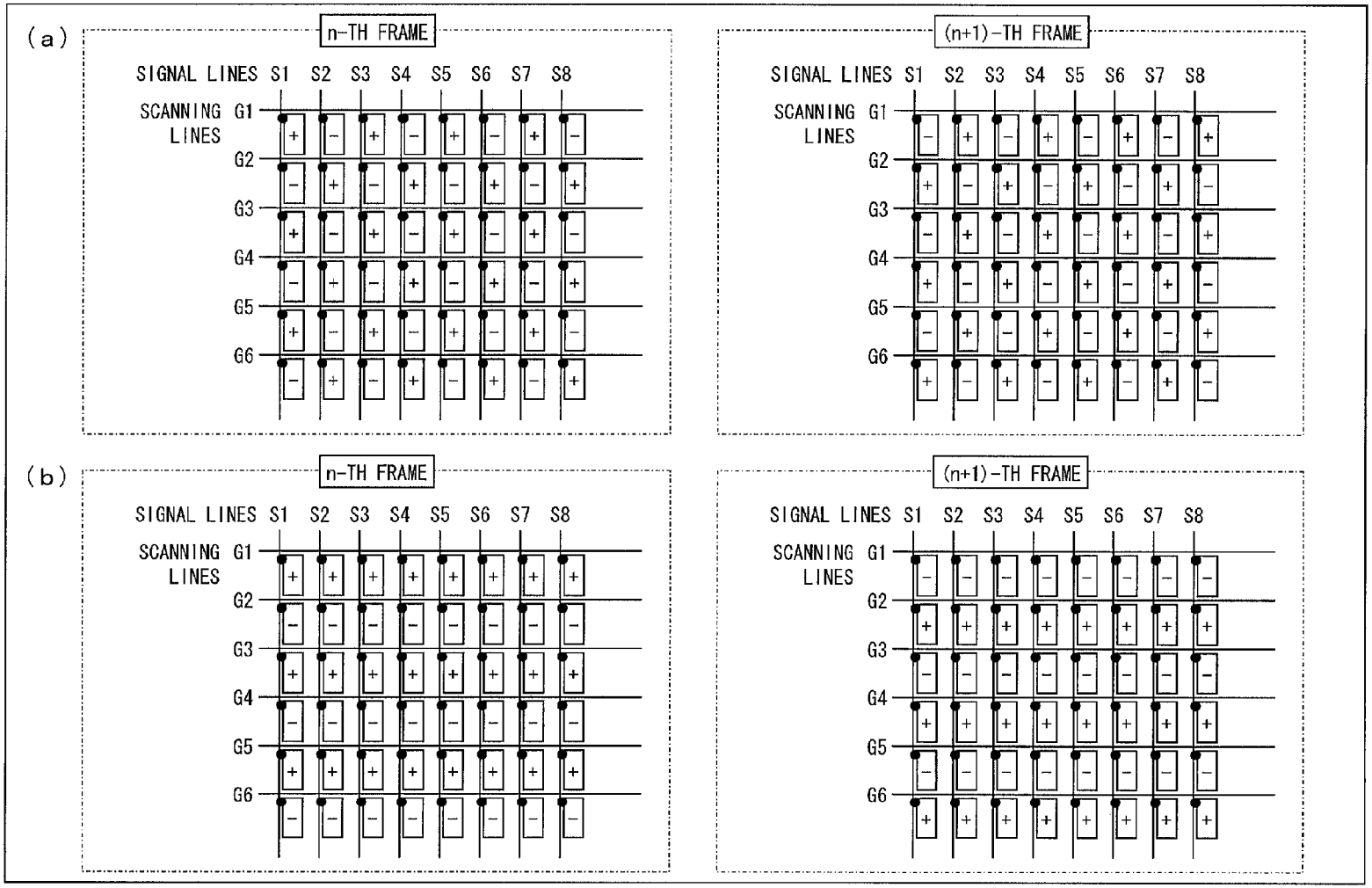

(a) and (b) of FIG. 15 are explanatory views illustrating how a display panel is driven.

Figure 16:
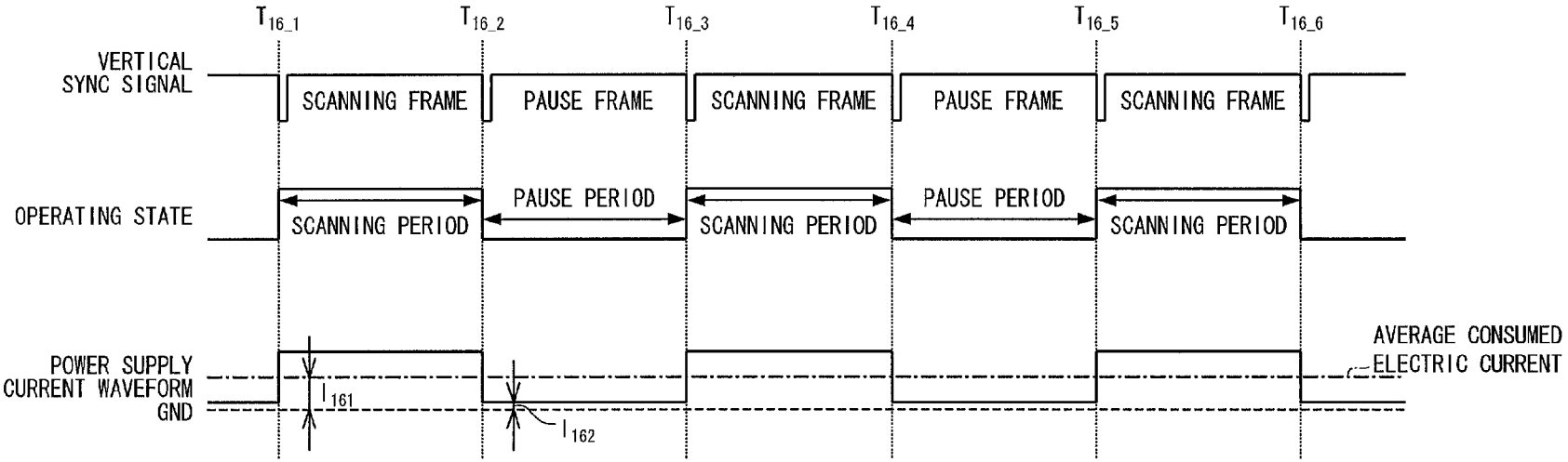

FIG. 16 is a timing diagram showing a vertical sync signal, an operating state, and a waveform of a power supply current of a conventional display device.

Figure 17:
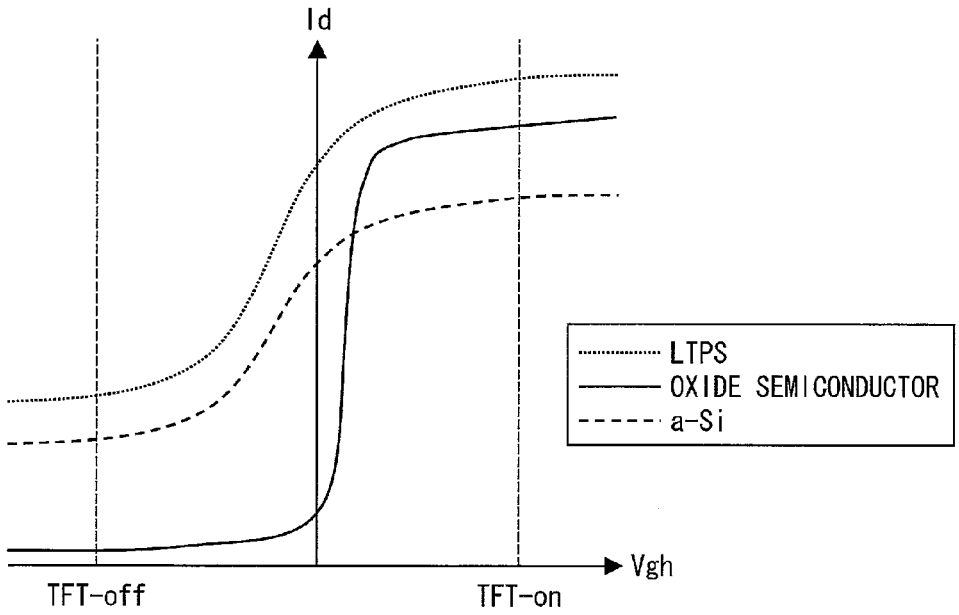

FIG. 17 is a graph showing a characteristic of a TFT made from an oxide semiconductor.

DESCRIPTION OF EMBODIMENTS

Embodiment 1

Figure 1:
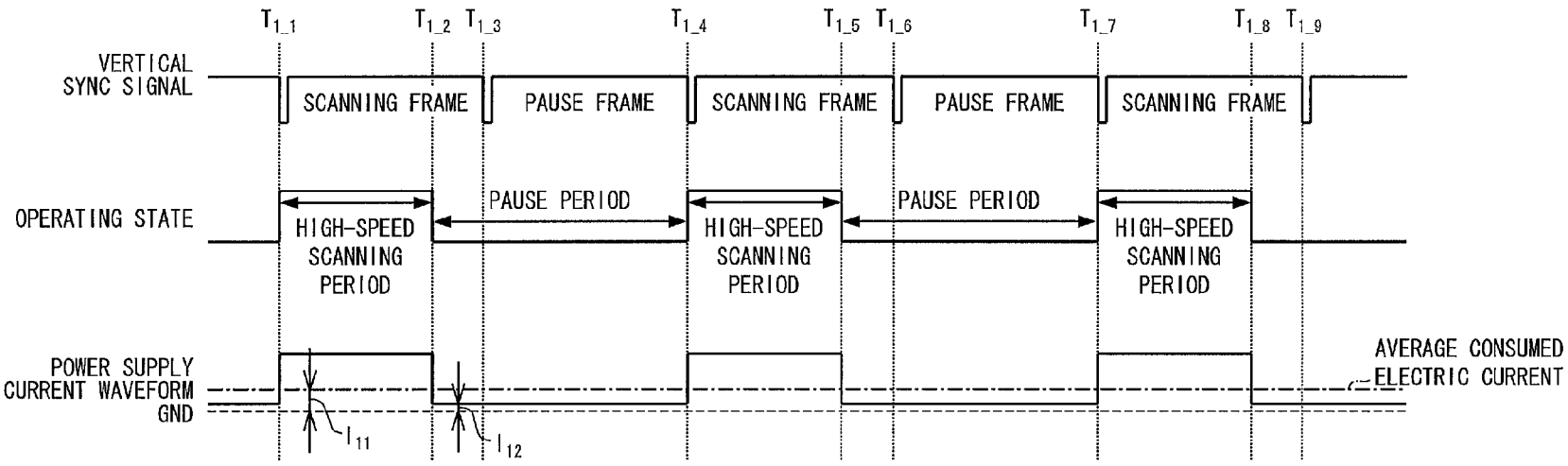
FIG. 1 is a timing diagram showing a vertical sync signal, an operating state, and a waveform of a power supply current of a display device according to an embodiment of the present invention.
Figure 2:
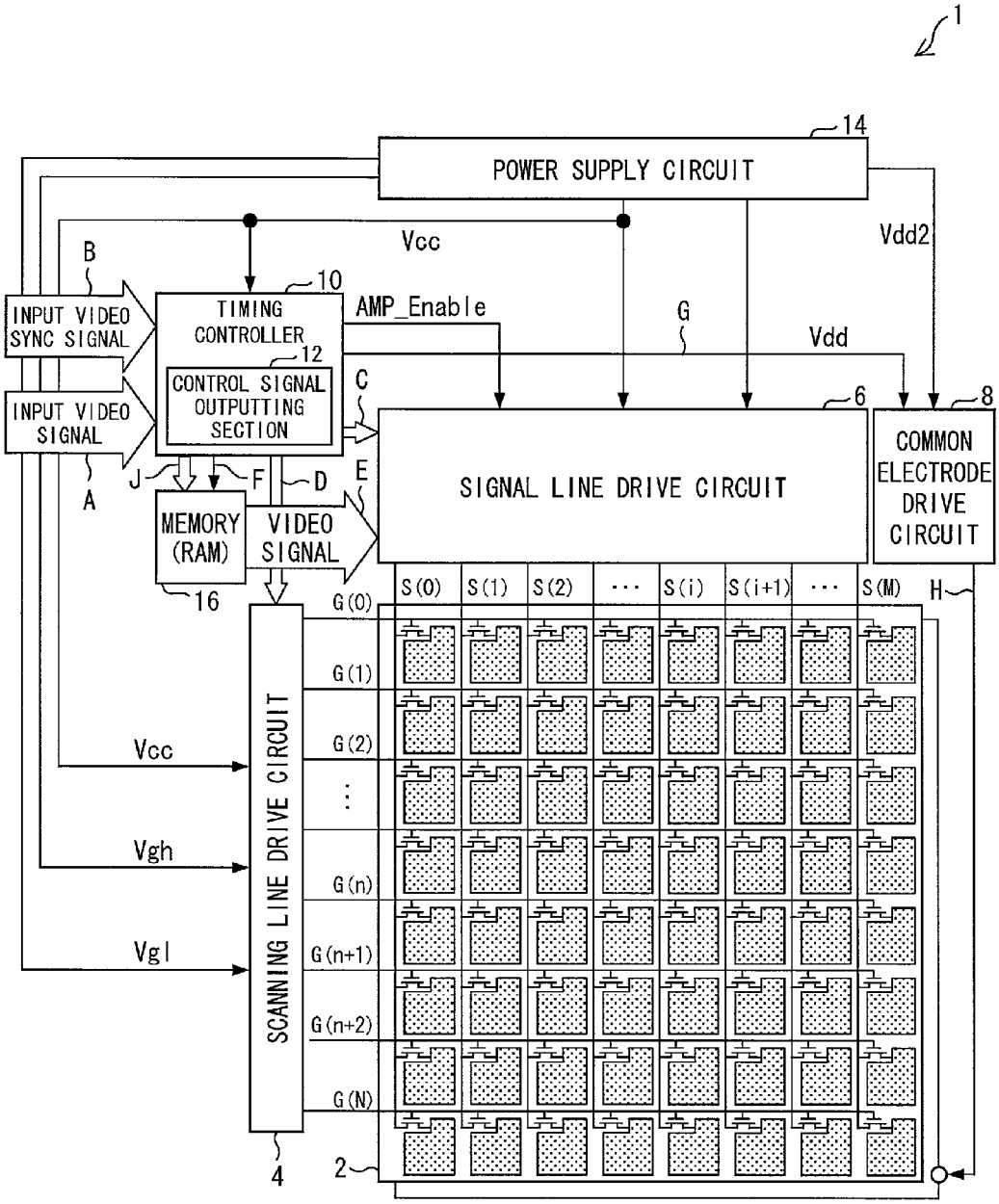
FIG. 2 is a block diagram schematically illustrating a configuration of the display device.
Figure 3:
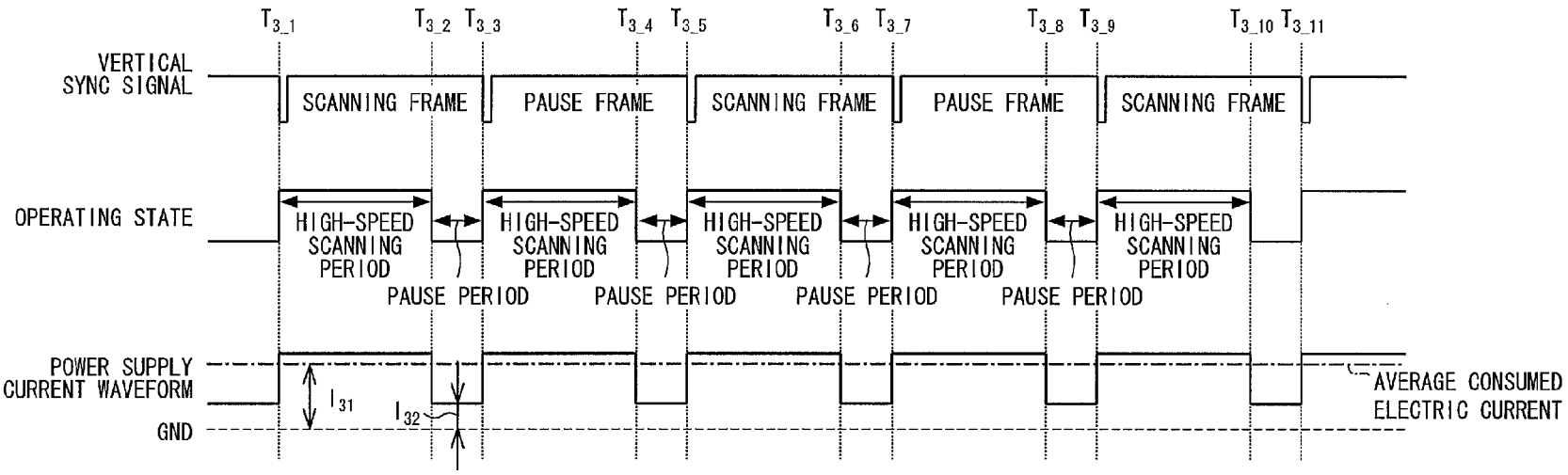
FIG. 3 is a timing diagram showing a vertical sync signal, an operating state, and a waveform of a power supply current of a comparative configuration of the display device.

The following description will discuss, with reference to FIGS. 1 through 3, an embodiment of the present invention.

(Configuration of Display Device 1)

First, the following description will discuss, with reference to FIG. 2, a configuration of a display device (liquid crystal display device) 1 according to the present invention. FIG. 2 is a view illustrating an entire configuration of the display device 1. As illustrated in FIG. 2, the display device 1 includes a display panel 2, a scanning line drive circuit (gate driver) 4, a signal line drive circuit (source driver) 6, a common electrode drive circuit 8, a timing controller 10, a power supply circuit 14, and a memory 16. The timing controller 10 includes a control signal outputting section 12.

The display panel 2 includes (i) a screen which is constituted by a plurality of pixels arranged in a matrix pattern, (ii) N (N is any integer) scanning signal lines G (gate lines) which are provided so that parts of the screen are scanned while being line-sequentially selected, and (iii) M (M is any integer) data signal lines S (source lines) which are provided so that a data signal is supplied to pixels which belong to a selected line of the scanning signal lines G. The scanning signal lines G and the data signal lines S intersect with each other.

The display panel 2 can be, for example, a liquid crystal display panel. In this case, the display device 1 can be provided as a liquid crystal display device. Further, the display panel 2 can be an EL display panel such as an organic electroluminescent (EL) display panel. In this case, the display device 1 can be provided as an electroluminescent display device.

G(n) illustrated in FIG. 2 indicates the n-th (n is any integer) scanning signal line G. For example, G(1), G(2), and G(3) indicate the respective first, second, and third scanning signal lines G. On the other hand, S(i) indicates the i-th (i is any integer) data signal line S. For example, S(1), S(2), and S(3) indicate the respective first, second, and third data signal lines S.

Note that, for easy explanation, the present embodiment describes an example case in which an equivalent circuit is driven, and in which each pixel in the display panel 2 is provided with a TFT having a drain connected with a pixel electrode.

The scanning line drive circuit 4 line-sequentially scans the scanning signal lines G from the top to the bottom of the screen. While line-sequentially scanning the scanning signal lines G, the scanning line drive circuit 4 supplies, to each of the scanning signal lines G, a rectangular wave (scanning signal) for turning on switching elements (TFTs) which are provided to respective pixels and connected to respective pixel electrodes. This causes pixels belonging to a line of the scanning signal lines G in the screen to be selected.

The signal line drive circuit 6 (i) calculates, in accordance with a video signal supplied from the memory 16 (see an arrow E shown in FIG. 2), a value of a voltage to be supplied to each of the pixels belonging to the selected line of the scanning signal lines G and (ii) then supplies, to each of the data signal lines S, the voltage having the value. As a result, image data (data signal) is supplied to the each of the pixels belonging to the selected line of the scanning signal lines G.

The display device 1 further includes a common electrode (COM: not shown) which is common to the pixels in the screen. The common electrode drive circuit 8 drives the common electrode by supplying, to the common electrode, a predetermined common voltage in accordance with a reverse polarity signal supplied from the timing controller 10 (see an arrow G shown in FIG. 2).

The timing controller 10 receives, from a main device (not shown), a horizontal sync signal (Hsync) and a vertical sync signal (Vsync) each serving as an input video sync signal, and an input clock signal (DotClock signal) (see an arrow B shown in FIG. 2). The timing controller 10 generates, in accordance with the input video sync signals and the input clock signal (DotClock signal), a horizontal sync control signal (e.g., GCK) and a vertical sync control signal (e.g., GSP) each serving as a video sync signal, which is a standard by which circuits operate in sync with each other. The timing controller 10 supplies the horizontal sync control signal and the vertical sync control signal to each of the scanning line drive circuit 4, the signal line drive circuit 6, and the memory 16 (see arrows C, D, and F shown in FIG. 2). The timing controller 10 receives, from the main device (not shown), an input video signal (see an arrow A shown in FIG. 2).

The horizontal sync control signal is used as an output timing signal which controls a timing at which the signal line drive circuit 6 supplies, to the display panel 2, the video signal received from the memory 16. Further, the horizontal sync control signal is used as a timing signal which controls a timing at which the scanning line drive circuit 4 supplies a scanning signal to the display panel 2.

The vertical sync control signal is used as a timing signal which controls a timing at which the scanning line drive circuit 4 starts scanning the scanning signal lines G.

In accordance with the horizontal sync control signal and the vertical sync control signal which have been received from the timing controller 10, the scanning line drive circuit 4 starts scanning the display panel 2 so as to supply the scanning signal to each of the scanning signal lines G while sequentially selecting the scanning signal lines G.

In accordance with the horizontal sync control signal received from the timing controller 10, the signal line drive circuit 6 writes, to each of the data signal lines S of the display panel 2, the image data (data signal) based on the video signal received from the memory 16.

The power supply circuit 14 generates Vdd, Vdd2, Vcc, Vgh, and Vgl, which are voltages necessary for the respective circuits in the display device 1 to operate. The power supply circuit 14 supplies Vcc, Vgh, and Vgl to the scanning line drive circuit 4, Vdd and Vcc to the signal line drive circuit 6, Vcc to the timing controller 10, and Vdd2 to the common electrode drive circuit 8.

The memory 16 has the function of recording the input video signal received from the timing controller 10 (see an arrow J shown in FIG. 2). In accordance with the video sync signal received from the timing controller 10, the memory 16 supplies, to the signal line drive circuit 6, the video signal (see the arrow E shown in FIG. 2) based on the input video signal which has been recorded. When the main device transmits the video signal (arrow A) and the video sync signals (arrow B) to the timing controller 10, the main device, owing to provision of the memory 16, does not have to convert each of these signals into a signal having a speed in accordance with scanning carried out by the display device 1. Accordingly, the main device can use the same circuit configuration as that in a conventional technique, without the need to include a special circuit which is separately provided in accordance with a speed of the scanning carried out by the display device 1. In other words, it becomes possible to suppress an increase in production cost of the main device.

(Electric Power Consumption Display Device 1)

First, the following description will discuss electric power consumption of a comparative configuration of the display device 1. FIG. 3 is a view showing electric power consumption of the comparative configuration of the display device 1, specifically a timing diagram showing a vertical sync signal, an operating state, and a waveform of a power supply current of the comparative configuration of the display device 1.

As shown in FIG. 3, in the comparative configuration of the display device 1, a single scanning period and a single pause period are set to a single frame, for example, to each of a plurality of frames such as a frame between $t_{3_1}$ and $t_{3_3}$ and a frame between $t_{3_3}$ and $t_{3_5}$. That is, in the frame between $t_{3_1}$ and $t_{3_3}$, a high-speed scanning period for carrying out high-speed scanning is set between $t_{3_1}$ and $t_{3_2}$, and a pause period is set between $t_{3_2}$ and $t_{3_3}$. Likewise, in the frame between $t_{3_3}$ and $t_{3_5}$, a high-speed scanning period for carrying out a high-speed scanning is set between $t_{3_3}$ and $t_{3_4}$, and a pause period is set between $t_{3_4}$ and $t_{3_5}$. For example, a normal scanning period is about 16 ms to 17 ms, which corresponds to a frequency of 60 Hz, whereas the high-speed scanning periods are each about 10 ms due to an increased driving frequency. In the present embodiment, "high-speed scanning" denotes such a scanning that allows the entire screen of the display panel 2 to be displayed in a period shorter than an entire period of a single frame.

Note that, in FIG. 3, each frame includes a scanning period and thus serves as a scanning frame. That is, a plurality of scanning frames occur in succession. The comparative configuration makes it possible to achieve a high display quality in which flickering on the screen is sufficiently suppressed.

In the comparative configuration of the display device 1, the high-speed scanning period is set in a single frame, in other words, in a single vertical period, so that a pause period is further set in the single frame. Accordingly, even in a case where a plurality of scanning frames are sequentially provided, it is possible to stop or suppress, in the pause period included in each scanning frame, generation of a self-consumed electric current which is consumed by drive circuits for driving scanning lines and signal lines of the display panel, a power supply circuit for supplying electric power to the drive circuits, and the like. Also in the comparative configuration, a reduction in value $I_{32}$ of the self-consumed electric current in the pause period allows reducing the electric power consumption of the display device.

However, in the comparative configuration, a scanning period and a pause period are set to a single frame, as described above. One problem arising from this is that a pause period has an insufficient length. This means that a period from a stop to a return of the drive circuits and the power supply circuit is short. That is, as shown in FIG. 3, the value $I_{32}$ of the self-consumed electric current cannot be reduced to around a ground potential GND. This makes it difficult to reduce significantly a value $I_{31}$ of an average consumed electric current relative to the ground potential GND.

Further, a ratio of a scanning period to a single frame that includes the scanning period cannot be reduced too significantly, that is, to an extent that allows generation of the above-described self-consumed electric current to be stopped or suppressed. This leads to another problem that, in a case where the display device uses source inversion driving, in which a positive data signal and a negative data signal are alternately supplied from the signal line drive circuit 6 to a single data signal line S by AC driving, degradation of display quality is caused by generation of a luminance gradient (described later).

By contrast, the display device 1 according to Embodiment 1 of the present invention is advantageous in that (i) the display device 1 can be driven by less electric power consumption than that for the above-described comparative configuration and (ii) degradation of display quality caused by generation of a luminance gradient can be prevented.

The following description will discuss the advantages of the display device 1. FIG. 1 is a timing diagram showing a vertical sync signal, an operating state, and a waveform of a power supply current of the display device 1.

As shown in FIG. 1, in the display device 1, a single high-speed scanning period and a single pause period are set to two consecutive frames, for example, a frame between $t_{1_1}$ and $t_{1_3}$ and a frame between $t_{1_3}$ and $t_{1_4}$, respectively.

The display device 1 is different from the display device described in Patent Literature 1 in that, instead of setting a scanning period set to an entire period of a preceding one (hereinafter also simply referred to as "preceding frame") of the two consecutive frames, the scanning period is speeded up so that the pause period is further set to a remaining period, which follows the end of the scanning period, in the preceding one of the two frames. As a matter of course, the pause period is set to an entire period of a subsequent one (hereinafter also simply referred to as "subsequent frame") of the two frames. Note that, in FIG. 1, a frame that includes a scanning period is called a scanning frame, and a frame that does not include a scanning period is called a pause frame.

For example, in a case where the frame between $t_{1_1}$ and $t_{1_3}$ is a preceding frame and the frame between $t_{1_3}$ and $t_{1_4}$ is a subsequent frame, a scanning period (high-speed scanning period) is set to a period between $t_{1_1}$ and $t_{1_2}$ in the preceding frame, and a pause period is set to a period between $t_{1_2}$ and $t_{1_3}$ in the preceding frame. The pause period is also set to an entire period of the subsequent frame.

Likewise, in a case where a frame between $t_{1_4}$ and $t_{1_6}$ is a preceding frame and a frame between $t_{1_6}$ and $t_{1_7}$ is a subsequent frame, a scanning period (high-speed scanning period) is set to a period between $t_{1_4}$ and $t_{1_5}$ in the preceding frame, and a pause period is set to a period between $t_{1_5}$ and $t_{1_6}$ in the preceding frame. The pause period is also set to an entire period of the subsequent frame.

As described above, the display device 1 is configured such that, first, instead of setting a scanning period to an entire period of a preceding frame out of two consecutive frames, the scanning period is speeded up so that a pause period is set to a remaining period, which follows the end of the scanning period, in the preceding frame. The pause period is further set to an entire period of a subsequent frame out of the two consecutive frames.

This allows the display device 1 to have a significant increase in ratio of the pause period to the scanning period in an entire period of the two consecutive frames, as compared with the display device described in Patent Literature 1 and the comparative configuration of the display device. This makes it possible to more effectively stop or suppress generation of a self-consumed electric current which is consumed by the scanning line drive circuit 4 and the signal line drive circuit 6 for driving the scanning signal lines G and the data signal lines S of the display panel 2, the power supply circuit 14 for supplying electric power to the scanning line drive circuit 4 and the signal line drive circuit 6, and the like. A reduction in value $I_{12}$ of the self-consumed electric current in the pause period, which is sufficiently long, allows a significant reduction in value $I_{11}$ of an average consumed electric current relative to a ground potential GND. This allows a significant reduction in electric power consumption of the display device 1.

In other words, in the display device 1, a ratio of the scanning period to the pause period in the entire period of the two consecutive frames can be significantly reduced as compared with the display device described in Patent Literature 1 and the comparative configuration of the display device. This makes it possible to prevent degradation of display quality caused by generation of a luminance gradient. This point will be described later as well as the principle by which a luminance gradient is generated.

Embodiment 2

Figure 4:
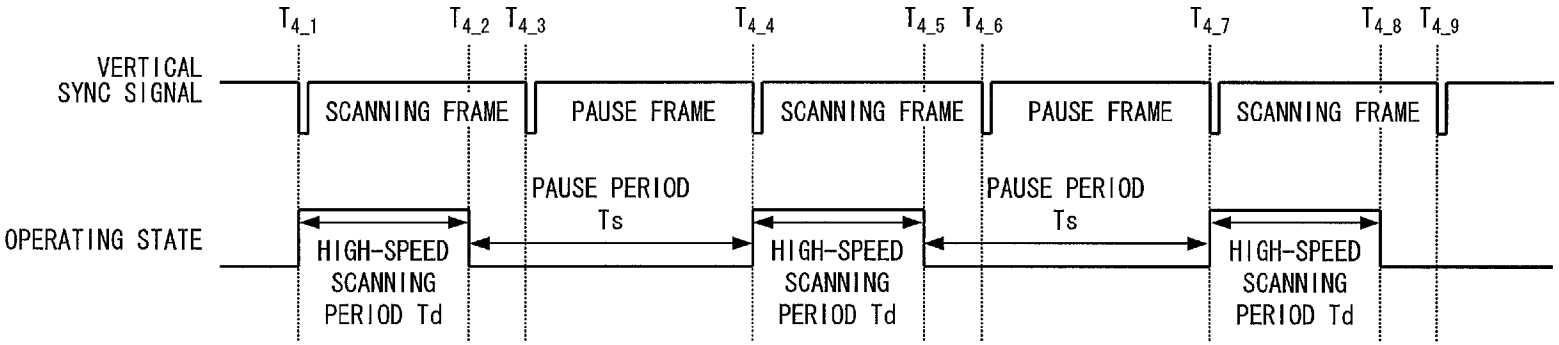
FIG. 4 is a timing diagram showing a vertical sync signal and an operating state of a display device according to another embodiment of the present invention.

Next, Embodiment 2 of the present invention will be described. FIG. 4 is a timing diagram showing a vertical sync signal and an operating state of a display device according to Embodiment 2 of the present invention. Note that the display device according to Embodiment 2 of the present invention has the same configuration as that of the display device 1 of Embodiment 1 illustrated in FIG. 2. The following description will discuss a difference between the display device according to Embodiment 2 and the display device 1 of Embodiment 1.

As shown in FIG. 4, in the display device 1 according to Embodiment 2 of the present invention, a single high-speed scanning period and a single pause period are set to two consecutive frames, for example, to a frame between $T_{4_1}$ and $T_{4_3}$ and a frame between $T_{4_3}$ and $T_{4_4}$, respectively.

Further, the display device 1 is configured such that, instead of setting the scanning period to an entire period of a preceding frame out of the two consecutive frames, the scanning period is speeded up so that the pause period is further set to a remaining period that follows the end of the scanning period in the preceding frame. The pause period is set to an entire period of a subsequent frame out of the two frames.

The description so far also applies to Embodiment 1. The difference between Embodiment 2 of the present invention and Embodiment 1 is that the following relation is maintained between a high-speed scanning period Td and a pause period Ts in the two consecutive frames.

$$Td \leq (1/2) \cdot Ts \quad \text{[Math 1]}$$

What is meant by the relation in FIG. 4 is that, for example, a period between $T_{4_1}$ and $T_{4_2}$ is shorter than a half of a period between $T_{4_2}$ and $T_{4_4}$.

According to Embodiment 2 of the present invention, it is possible to significantly reduce electric power consumption of the display device 1 as in Embodiment 1.

Embodiment 3

Figure 5:
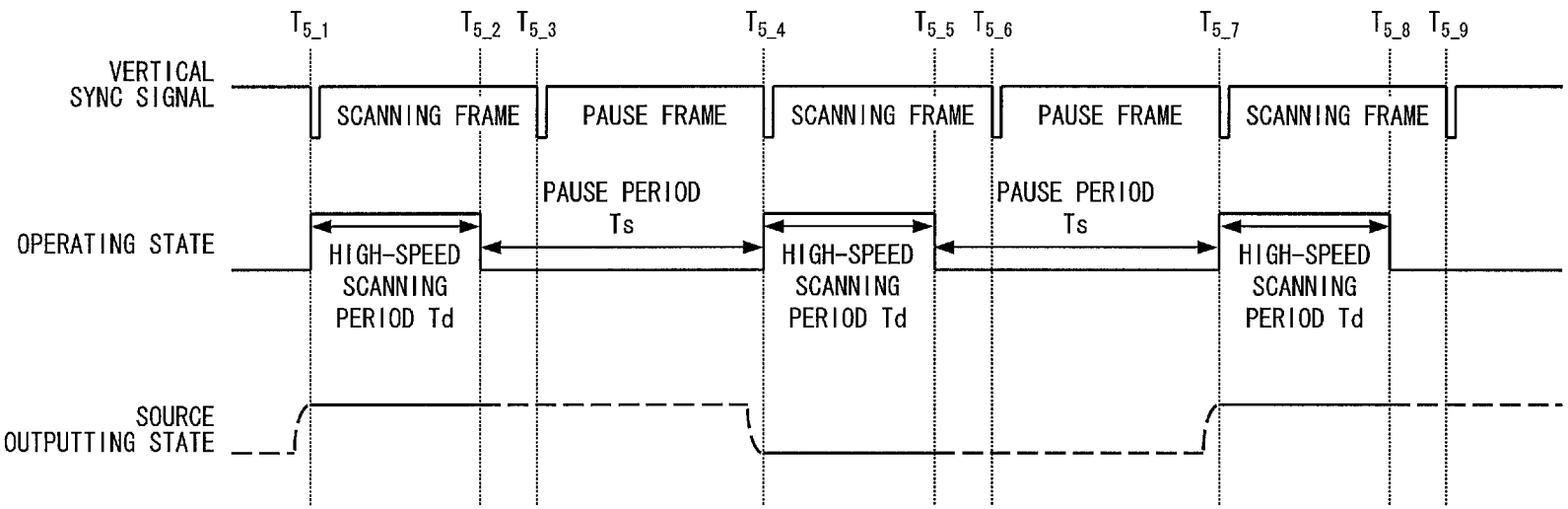
FIG. 5 is a timing diagram showing a vertical sync signal, an operating state, and a source outputting state of a display device according to another embodiment of the present invention.

Next, Embodiment 3 of the present invention will be described. FIG. 5 is a timing diagram showing a vertical sync signal, an operating state, and a source outputting state of a display device according to Embodiment 3 of the present invention. Note that the display device of Embodiment 3 of the present invention has the same configuration as that of the display device 1 of Embodiment 1 as illustrated in FIG. 2. The following description will discuss a difference between the display device of Embodiment 3 and the display device 1 of Embodiment 1.

As shown in FIG. 5, in the display device 1 according to Embodiment 3 of the present invention, a single high-speed scanning period and a single pause period are set to two consecutive frames, for example, a frame between $T_{5_1}$ and $T_{5_3}$ and a frame between $T_{5_3}$ and $T_{5_4}$, respectively.

Further, the display device 1 is configured such that, instead of setting the scanning period to an entire period of a preceding frame out of the two consecutive frames, the scanning period is speeded up so that the pause period is further set to a remaining period that follows the end of the scanning period in the preceding frame. The pause period is set to an entire period of a subsequent frame out of the two frames.

The description so far also applies to Embodiment 1. The difference between Embodiment 3 of the present invention and Embodiment 1 is that Embodiment 3 combines source inversion driving, in which a positive data signal and a negative data signal are alternately supplied from the signal line drive circuit 6 to a single data signal line S by AC driving.

In FIG. 5, the source outputting state is positive in the frame between $T_{5_1}$ and $T_{5_3}$ and the frame between $T_{5_3}$ and $T_{5_4}$, which are two consecutive frames, and the source outputting state is negative in the frame between $T_{5_4}$ and $T_{5_6}$ and the frame between $T_{5_6}$ and $T_{5_7}$, which are two consecutive frames.

According to Embodiment 3 of the present invention, it is possible to significantly reduce electric power consumption of the display device 1 as in Embodiment 1, and also to prevent degradation of display quality caused by generation of a luminance gradient.

Embodiment 4

Figure 6:
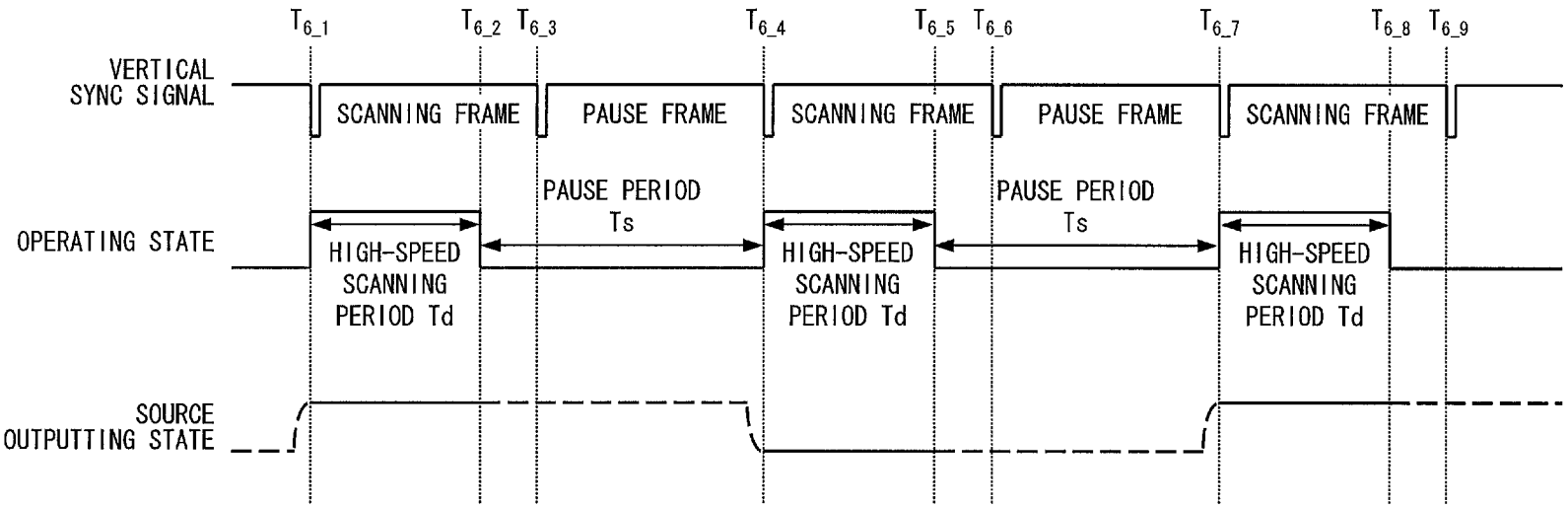
FIG. 6 is a timing diagram showing a vertical sync signal, an operating state, and a source outputting state of a display device according to another embodiment of the present invention.

Next, Embodiment 4 of the present invention will be described. FIG. 6 is a timing diagram showing a vertical sync signal, an operating state, and a source outputting state of a display device according to Embodiment 4 of the present invention. Note that the display device of Embodiment 4 of the present invention has the same configuration as that of the display device 1 of Embodiment 1 as illustrated in FIG. 2. The following description will discuss a difference between the display device of Embodiment 4 and the display device 1 of Embodiment 1.

As shown in FIG. 6, in the display device 1 according to Embodiment 4 of the present invention, a single high-speed scanning period and a single pause period are set to two consecutive frames, for example, a frame between $T_{6_1}$ and $T_{6_3}$ and a frame between $T_{6_3}$ and $T_{6_4}$, respectively.

Further, the display device 1 is configured such that, instead of setting the scanning period to an entire period of a preceding frame out of the two consecutive frames, the scanning period is speeded up so that the pause period is further set to a remaining period that follows an end of the scanning period in the preceding frame. The pause period is set to an entire period of a subsequent frame out of the two frames.

The difference between Embodiment 4 of the present invention and Embodiment 1 is that, like Embodiment 2, the following relation is maintained between a high-speed scanning period Td and a pause period Ts the two consecutive frames.

$$Td \leq (1/2) \cdot Ts \quad \text{[Math 2]}$$

What is meant by the relation in FIG. 6 is that, for example, a period between $T_{6_1}$ and $T_{6_2}$ is shorter than a half of a period between $T_{6_2}$ and $T_{6_4}$.

Further, the difference between Embodiment 4 of the present invention and Embodiment 1 is that, like Embodiment 3, Embodiment 4 combines source inversion driving, in which a positive data signal and a negative data signal are alternately supplied from the signal line drive circuit 6 to a single data signal line S by AC driving.

In FIG. 6, the source outputting state is positive in the frame between $T_{6_1}$ and $T_{6_3}$ and the frame between $T_{6_3}$ and $T_{6_4}$, which are two consecutive frames, and the source outputting state is negative in the frame between $T_{6_4}$ and $T_{6_6}$ and the frame between $T_{5_6}$ and $T_{5_7}$, which are two consecutive frames.

According to Embodiment 4 of the present invention, it is possible to significantly reduce electric power consumption of the display device 1 as in Embodiment 1, and also to prevent degradation of display quality caused by generation of a luminance gradient.

Embodiment 5

Figure 7:
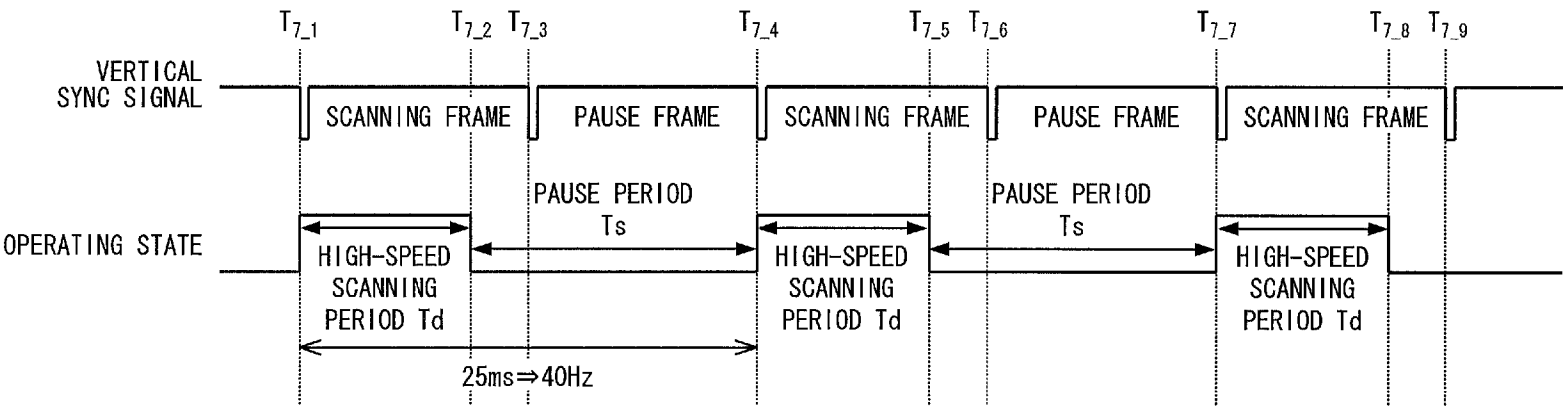
FIG. 7 is a timing diagram showing a vertical sync signal, and an operating state of a display device according to another embodiment of the present invention.

Next, Embodiment 5 of the present invention will be described. FIG. 7 is a timing diagram showing a vertical sync signal and an operating state of a display device according to Embodiment 5 of the present invention. Note that the display device of Embodiment 5 of the present invention has the same configuration as that of the display device 1 of Embodiment 1 as illustrated in FIG. 2. The following description will discuss a difference between the display device of Embodiment 5 and the display device 1 of Embodiment 1.

As shown in FIG. 7, in the display device 1 according to Embodiment 5 of the present invention, a single high-speed scanning period and a single pause period are set to two consecutive frames, for example, a frame between $T_{7_1}$ and $T_{7_3}$ and a frame between $T_{7_3}$ and $T_{7_4}$, respectively.

Further, the display device 1 is configured such that, instead of setting the scanning period to an entire period of a preceding frame out of the two consecutive frames, the scanning period is speeded up so that the pause period is further set to a remaining period that follows an end of the scanning period in the preceding frame. The pause period is set to an entire period of a subsequent frame out of the two frames.

The description so far also applies to Embodiment 1. The difference between Embodiment 5 of the present invention and Embodiment 1 is that a driving frequency (refresh rate) is set to at least about 40 Hz in the two consecutive frames. That is, the difference is that the following relation is maintained between a high-speed scanning period Td and a pause period Ts.

$$1/(Td+Ts) \geq 40 \text{ Hz} \quad \text{[Math 3]}$$

What is meant by the relation in FIG. 7 is that, for example, a period between $T_{7_1}$ and $T_{7_4}$ is about 25 ms.

According to Embodiment 5 of the present invention, a ratio of a high-speed scanning period to two consecutive frames is not reduced. This makes it possible to reduce electric power consumption without causing flickering.

Embodiment 6

Figure 8:
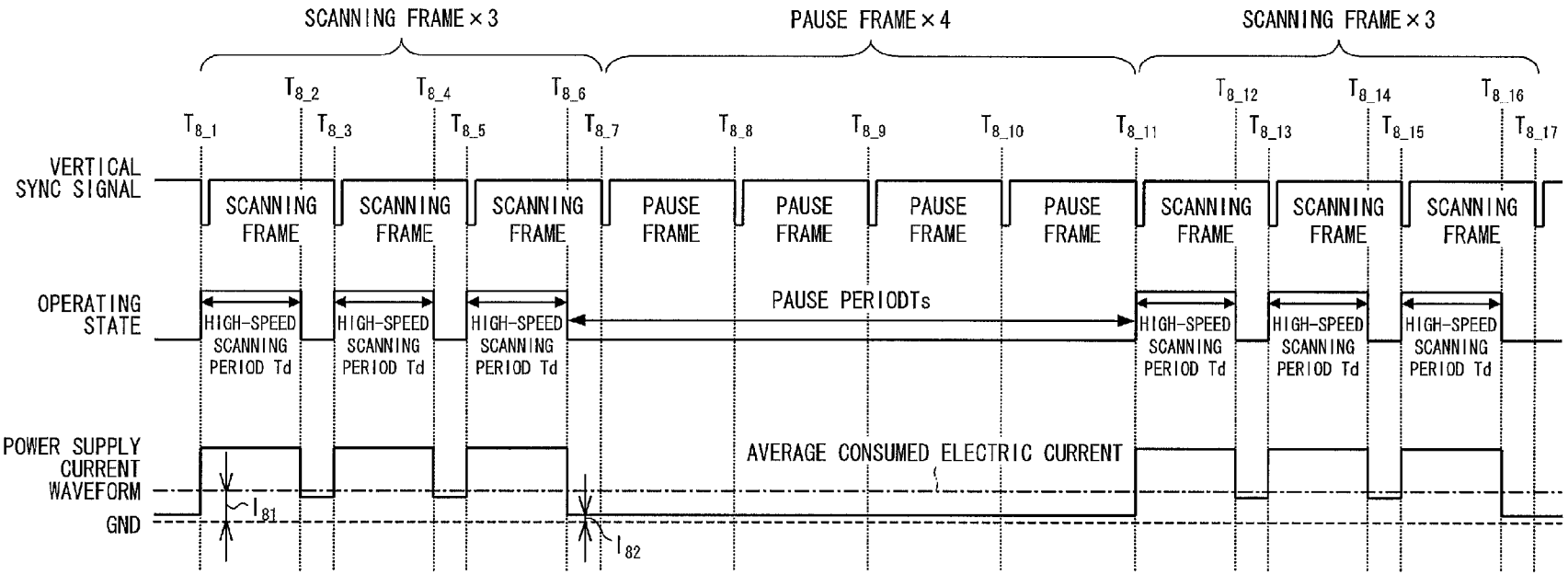
FIG. 8 is a timing diagram showing a vertical sync signal, an operating state, and a waveform of a power supply current of a display device according to another embodiment of the present invention.

Next, Embodiment 6 of the present invention will be described. FIG. 8 is a timing diagram showing a vertical sync signal, an operating state, and a waveform of a power supply current of a display device according to Embodiment 6 of the present invention. Note that the display device of Embodiment 6 of the present invention has the same configuration as that of the display device 1 of Embodiment 1 as illustrated in FIG. 2. The following description will discuss a difference between the display device of Embodiment 6 and the display device 1 of Embodiment 1.

Embodiments 1 through 5 described above are configured such that a scanning frame and a pause frame are alternated. By contrast, Embodiment 6 of the present invention is configured such that a plurality of consecutive pause frames follow a plurality of consecutive scanning frames. That is, (i) the plurality of consecutive scanning frames and (ii) the plurality of consecutive pause frames alternate with each other.

As shown in FIG. 8, first, a scanning frame is set between $T_{8_1}$ and $T_{8_3}$, between $T_{8_3}$ and $T_{8_5}$, and between $T_{8_5}$ and $T_{8_7}$. That is, three scanning frames occur in succession.

Next, a pause frame is set between $T_{8_7}$ and $T_{8_8}$, between $T_{8_8}$ and $T_{8_9}$, between $T_{8_9}$ and $T_{8_10}$, and between $T_{8_10}$ and $T_{8_11}$. That is, four scanning frames occur in succession.

Then, a scanning frame is set between $T_{8_11}$ and $T_{8_13}$, between $T_{8_13}$ and $T_{8_15}$, and between $T_{8_15}$ and $T_{8_17}$. That is, three scanning frames occur in succession.

A focus on the scanning frame between $T_{8_5}$ and $T_{8_7}$ and the pause frame between $T_{8_7}$ and $T_{8_8}$ shows that similar descriptions as given in Embodiments 1 through 5 apply to Embodiment 5. That is, first, instead of setting the scanning period in an entire period of a preceding frame (the scanning frame between $T_{8_5}$ and $T_{8_7}$) of these two consecutive frames, the scanning period is speeded up so that a pause period is set to a remaining period, which follows an end of the scanning period, in the preceding frame. The pause period is further set in an entire period of a subsequent frame (the pause frame between $T_{8_7}$ and $T_{8_8}$).

Accordingly, a reduction in value $I_{82}$ of a self-consumed electric current in the pause period, which follows an end of the scanning period and is sufficiently long, allows a significant reduction in value $I_{81}$ of an average consumed electric current relative to a ground potential GND. This allows a significant reduction in electric power consumption of the display device 1.

Therefore, even in a case, as Embodiment 6 of the present invention, where a plurality of consecutive pause frames follow a plurality of consecutive scanning frames, it is possible to significantly reduce electric power consumption of the display device 1 as in Embodiment 1, and also to prevent degradation of display quality caused by generation of a luminance gradient.

Embodiment 7

Figure 9:
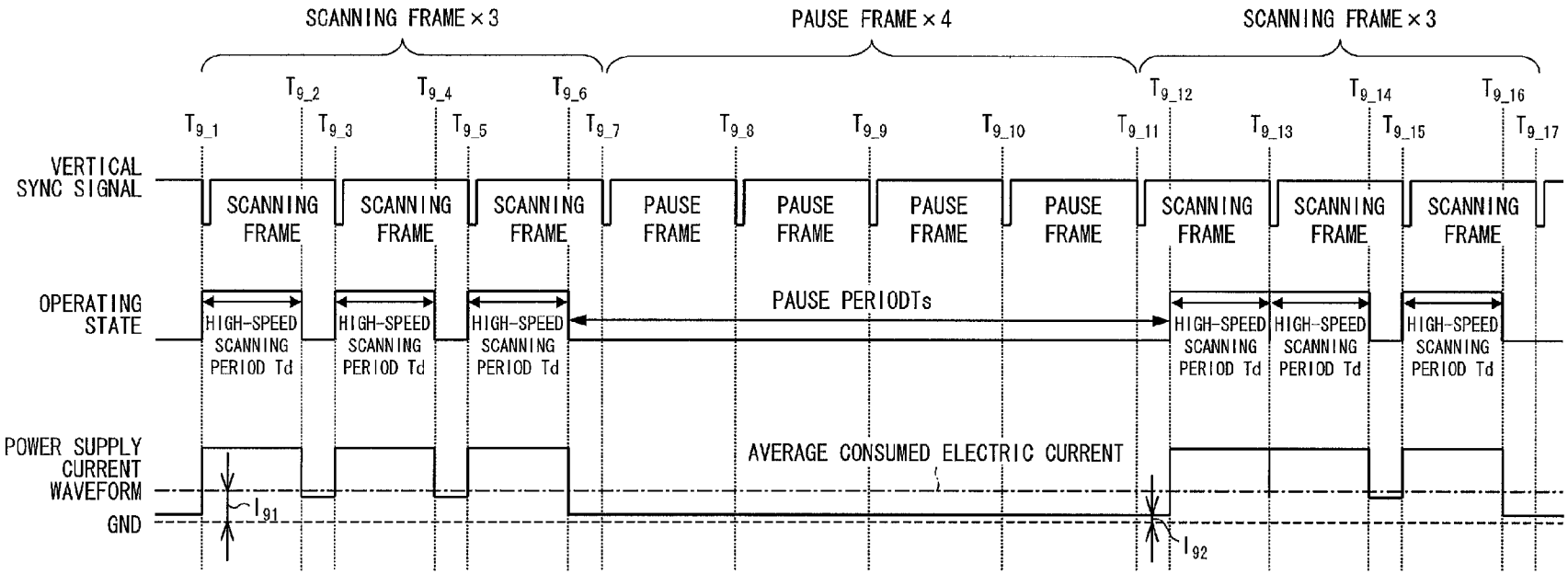
FIG. 9 is a timing diagram showing a vertical sync signal, an operating state, and a waveform of a power supply current of a display device according to another embodiment of the present invention.

Next, Embodiment 7 of the present invention will be described. FIG. 9 is a timing diagram showing a vertical sync signal, an operating state, and a waveform of a power supply current of a display device according to Embodiment 7 of the present invention. Note that the display device of Embodiment 7 of the present invention has the same configuration as that of the display device 1 of Embodiment 1 as illustrated in FIG. 2. The following description will discuss a difference between the display device of Embodiment 7 and the display device 1 of Embodiment 1.

Embodiment 7 of the present invention is configured similarly as Embodiment 6 such that a plurality of consecutive pause frames follow a plurality of consecutive scanning frames. That is, (i) the plurality of consecutive scanning frames and (ii) the plurality of consecutive pause frames alternate with each other.

As shown in FIG. 9, first, a scanning frame is set between $T_{9_1}$ and $T_{9_3}$, between $T_{9_3}$ and $T_{9_5}$, and between $T_{9_5}$ and $T_{9_7}$. That is, three scanning frames occur in succession.

Next, a pause frame is set between $T_{9_7}$ and $T_{9_8}$, between $T_{9_8}$ and $T_{9_9}$, between $T_{9_9}$ and $T_{9_10}$, and between $T_{9_10}$ and $T_{9_11}$. That is, four scanning frames occur in succession.

Then, a scanning frame is set between $T_{9_11}$ and $T_{9_13}$, between $T_{9_13}$ and $T_{9_15}$, and between $T_{9_15}$ and $T_{9_17}$. That is, three scanning frames occur in succession.

A focus on the pause frame between $T_{9_10}$ and $T_{9_11}$ and the scanning frame between $T_{9_11}$ and $T_{9_13}$ shows that, unlike Embodiments 1 through 6, first, a pause period is set to an entire period of a preceding frame (the pause frame between $T_{9_10}$ and $T_{9_11}$) of these two consecutive frames. Further, a pause period (between $T_{9_11}$ and $T_{9_12}$) is set first to a subsequent frame (the scanning frame between $T_{9_11}$ and $T_{9_13}$), and a high-speed scanning period (between $T_{9_12}$ and $T_{9_13}$) is set to a remaining period, which follows an end of the pause period, in the subsequent frame.

Accordingly, a reduction in value $I_{92}$ of a self-consumed electric current in the pause period, which precedes an end of the scanning period and is sufficiently long, allows a significant reduction in value $I_{91}$ of an average consumed electric current relative to a ground potential GND. This allows a significant reduction in electric power consumption of the display device 1.

Therefore, even in a case, as Embodiment 7 of the present invention, where a plurality of consecutive pause frames follow a plurality of consecutive scanning frames, it is possible to significantly reduce electric power consumption of the display device 1 as in Embodiment 1, and also to prevent degradation of display quality caused by generation of a luminance gradient.

[Generation of Luminance Gradient]

The following description will discuss (i) the principle by which a luminance gradient is generated and (ii) prevention of degradation in display quality caused by the generation of the luminance gradient.

Figure 10:
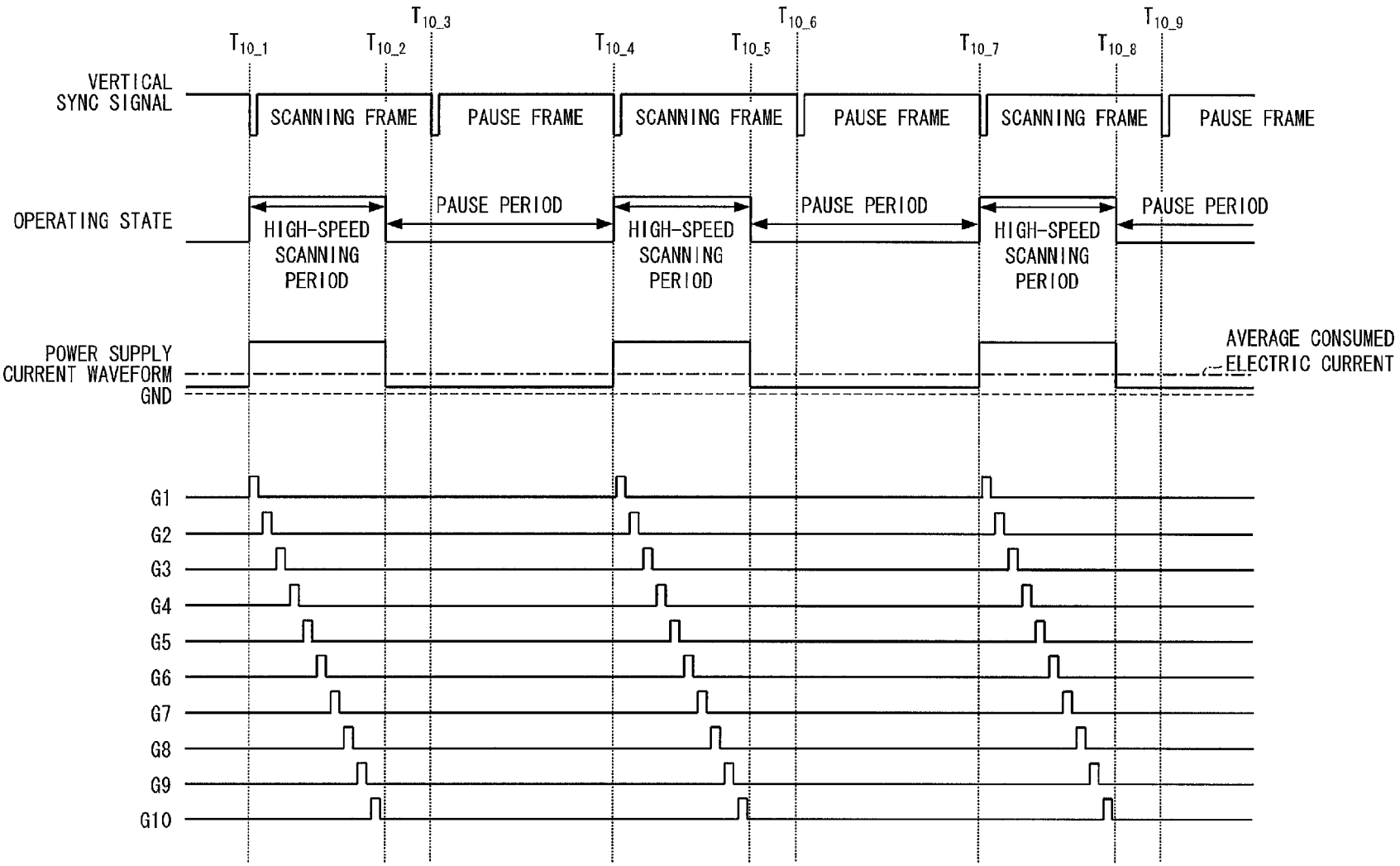
FIG. 10 is a timing diagram showing a vertical sync signal, an operating state, a waveform of a power supply current, and a scanning signal of the display device.

First, the following description will discuss driving of the display panel 2 of the display device 1 according to Embodiments 1 through 7 of the present invention. FIG. 10 is a timing diagram showing a vertical sync signal, an operating state, a waveform of a power supply current, and a scanning signal of the display device 1 according to Embodiments 1 through 7 of the present invention.

As shown in FIG. 10, a single high-speed scanning period and a single pause period are set to two consecutive frames, for example, a frame between $T_{10_1}$ and $T_{10_3}$ and a frame between $T_{10_3}$ and $T_{10_4}$, respectively. Instead of setting the scanning period to an entire period of a preceding frame out of the two consecutive frames, the pause period is set to a remaining period, which follows an end of the scanning period, in the preceding frame. Further, the pause period is set to an entire period of a subsequent frame out of the two frames.

Under such settings of scanning periods and pause periods, the vertical sync control signal is supplied for each high-speed scanning period. First, the control signal outputting section 12 changes a voltage of an AMP_Enable signal from an L value to an H value in sync with the vertical sync control signal. This causes a change in state of analog amplifiers (not shown) of the signal line drive circuit 6 from a non-operating state to an operating state (normal state).

Next, the scanning line drive circuit 4 supplies the scanning signal to the first scanning signal line G in sync with the vertical sync control signal and the horizontal sync control signal. This causes a state of gates of TFTs of pixels which are connected to the first scanning signal line G to be an on-state.

Next, in sync with the horizontal sync control signal, the signal line drive circuit 6 supplies, to each of the data signal lines S, the data signal via a corresponding analog amplifier, among the analog amplifiers in the signal line drive circuit 6, which is connected to the each of the data signal lines S. This causes a voltage necessary for a display to be supplied to the each of the data signal lines S. Accordingly, the voltage necessary for a display is written, via the TFTs, to pixel electrodes. In a case where the writing is completed, the state of the gates of the TFTs of the pixels which are connected to the first scanning signal line G returns from the on-state to an off-state.

After the first one horizontal period elapses, the next horizontal sync control signal is inputted. Pixels which are connected to the second and later scanning signal lines G are subjected to the writing by a process similar to that by which the writing is carried out with respect to the pixels which are connected to the first scanning signal line G. A period during which the writing is thus carried out with respect to the pixels connected to all the N scanning signal lines G is referred to as a "writing period". The writing period is a period identical to the high-speed scanning period.

The AMP_Enable signal maintains the H value during the writing period.

After the writing period (high-speed scanning period) elapses in the first high-speed scanning period, the control signal outputting section 12 changes a voltage of the AMP_Enable signal from the H value to the L value. This causes the state of the analog amplifiers in the signal line drive circuit 6 to be the non-operating state (have a lower performance).

After the first one vertical period elapses, the next vertical sync control signal is inputted. The second and later frames are driven by a process similar to the above process.

Note that during a period in which the analog amplifiers in the signal line drive circuit 6 are in the non-operating state (have a lower performance), the each of the data signal lines S and an output of a corresponding one of the analog amplifiers in the signal line drive circuit 6 may be disconnected from each other.

Next, the following description will discuss the principle by which a luminance gradient is generated. A gate of a TFT of each of the pixels included in the display panel 2 is, as described above, switched between an on-state and an off-state. A liquid crystal capacitor and a storage capacitor which are connected to each of the TFTs are charged by the switching between an on-state and an off-state of the gate of the each of the TFTs. It is generally well known that a feed-through phenomenon occurs in a liquid crystal display device as described above which employs a TFT as an element for selecting a pixel. The feed-through phenomenon is a factor by which a luminance gradient is generated. The following description will discuss the feed-through phenomenon.

Figure 11:
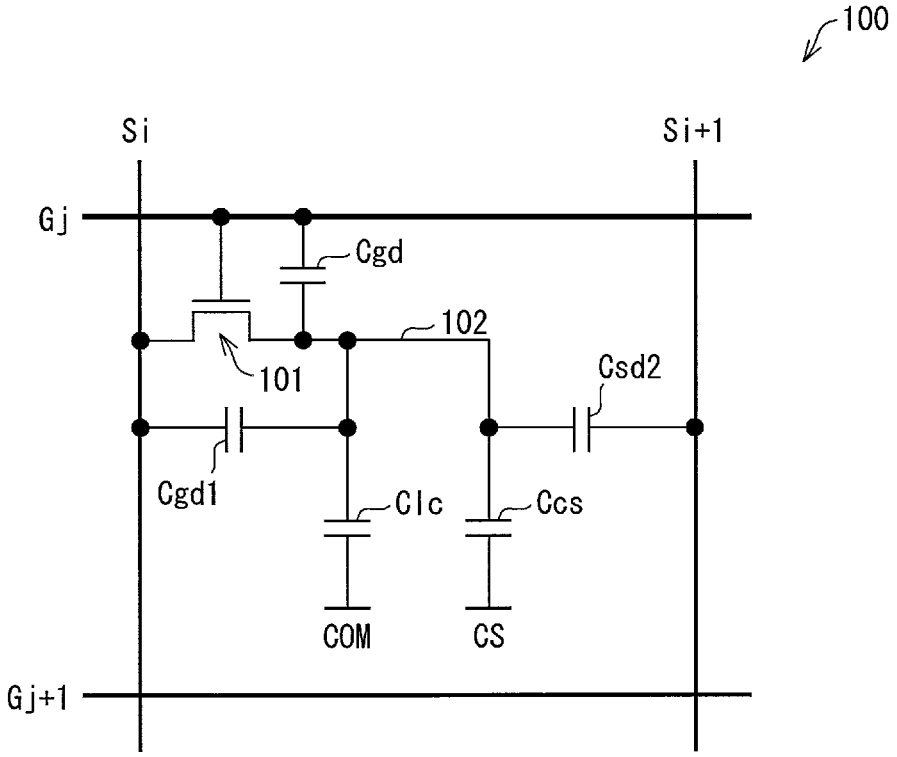
FIG. 11 is an equivalent circuit of one pixel.

FIG. 11 shows an equivalent circuit of one pixel. A pixel 100 is provided corresponding to an intersection between a gate line Gj and a source line Si. The pixel 100 includes a TFT 101, a liquid crystal capacitor Clc, and a storage capacitor Ccs. The pixel 100 further includes a parasitic capacitance such as a capacitance Cgd formed between a drain electrode 102 and the gate line Gj. A gate, a source, and a drain of the TFT 101 are connected to the gate line Gj, the source line Si, and the drain electrode 102, respectively. The liquid crystal capacitor Clc is formed by a liquid crystal layer provided between the drain electrode 102 and a common electrode to which a voltage COM is applied. The storage capacitor Ccs is formed by an insulating film provided between (i) the drain electrode 102 or an electrode connected to the drain electrode 102 and (ii) a storage capacitor bus line to which a voltage CS is applied. The voltage CS is, for example, equal to the voltage COM, but may have other voltage values.

An electric potential of the drain electrode 102 is first charged with a source voltage supplied from the source line Si via the TFT 101. Then, the electric potential of the drain electrode 102 changes in accordance with a change in voltage (Vgh→Vgl) on the gate line Gj via the parasitic capacitance Cgd. Further, since a parasitic capacitance Csd1 is formed, the electric potential of the drain electrode 102 also changes in accordance with a change in voltage caused by a reversal of polarity of the source line Si.

That is, in the equivalent circuit shown in FIG. 11, the following formulae (1) and (2) are met with respect to amounts of change in voltage of the drain electrode 102 relative to the source voltage. Note that ΔVgd is an amount of change caused by the parasitic capacitance Cgd, and ΔVsd1 is an amount of change caused by the parasitic capacitance Csd1.

[Math 4]

$$\Delta Vgd=(Cgd/\Sigma C)*\Delta Vg \quad (1)$$

$$\Delta Vsd1=(Csd1/\Sigma C)*\Delta Vs \quad (2)$$

ΣC, ΔVg, and ΔVs are calculated from the following formulae (3) through (5).

[Math 5]

$$\Sigma C\approx Clc+Ccs+Cgd+Csd1+Csd2 \quad (3)$$

$$\Delta Vg=|Vgh-Vgl| \quad (4)$$

$$\Delta Vs=|Vsh-Vsl| \quad (5)$$

Vgh, Vgl, Vsh, and Vsl are as follows.

[Math 6]

Vgh: Gate ON voltage
Vgl: Gate OFF voltage
Vsh: Source output High voltage
Vsl: Source output Low voltage Technically speaking, the electric potential of the drain electrode 102 is affected by the parasitic capacitance Csd2 as well as by the parasitic capacitance Csd1. However, an absolute value of an influence of the parasitic capacitance Csd2 on the drain electrode 102 is not so large enough to affect a luminance gradient, and is therefore ignored.

The amounts of change in electric potential of the drain electrode 102 expressed by the formulae (1) and (2) are each called a feed-through voltage.

Figure 12:
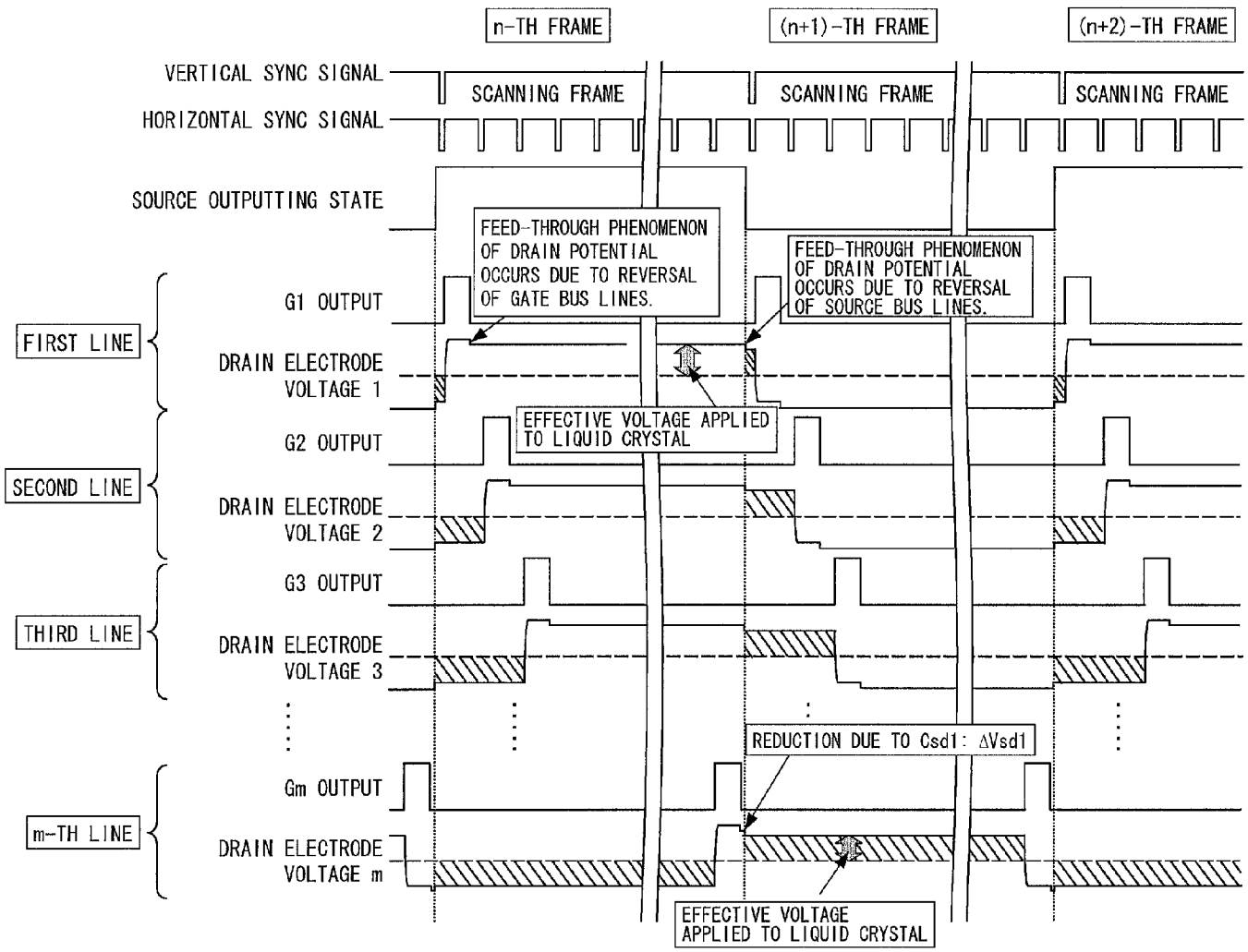
FIG. 12 is a timing diagram for illustrating the principle by which a luminance gradient is generated, the timing diagram showing a vertical sync signal, a horizontal sync signal, a source outputting state, and various signals.

Such feed-through voltages cause generation of a luminance gradient. For example, as shown in FIG. 12, a drain electrode is charged with a drain voltage, via a TFT of each pixel, by a data signal supplied from the signal line drive circuit 6. Then, the drain voltage is caused to change by the feed-through voltages due to a fall of a scanning signal and a reversal of polarity of the data signal. In particular, a timing at which a change in drain voltage is caused by the reversal of polarity of the data signal varies between the first line and the m-th line.

Accordingly, an effective voltage applied to liquid crystal is lower on the m-th line. As such, when the screen is viewed as a whole, a gradient of the voltage applied to the liquid crystal is generated along a scanning direction of the scanning line drive circuit 4. This leads to a luminance gradient.

Figure 13:
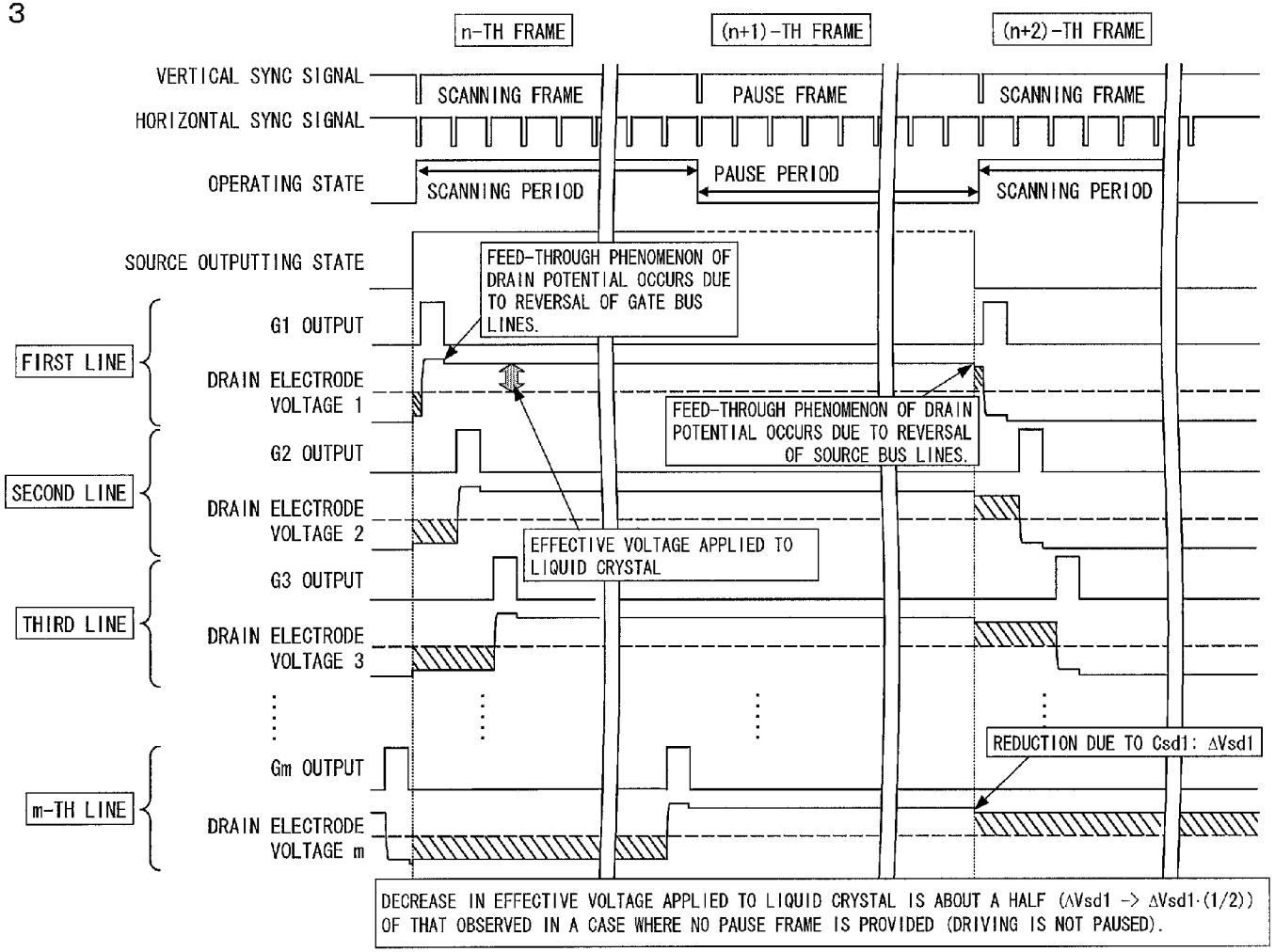
FIG. 13 is a timing diagram for illustrating the principle by which a luminance gradient is generated, the timing diagram showing a vertical sync signal, a horizontal sync signal, a source outputting state, and various signals.

On the other hand, as shown in FIG. 13, in a case where a pause frame (pause period) is interposed, a decrease, on the last line (the m-th line), in effective voltage applied to the liquid crystal is about a half (ΔVsd1→ΔVsd1·(½)) of that observed in a case where no pause frame is provided (i.e., driving is not paused) as shown in FIG. 11. That is, an amount of change in applied voltage is reduced, so that a luminance gradient is suppressed.

(Example of Application of the Present Invention)

As described above, the effect of preventing degradation of display quality caused by generation of a luminance gradient is exhibited by the present invention the most notably in a case where source inversion driving illustrated in (a) and (b) of FIG. 14 is used.

As a matter of course, the present invention exhibits the effect of reducing electric power consumption also in a case where dot inversion driving illustrated in (a) of FIG. 15 is used and in a case where line inversion driving illustrated in (b) of FIG. 15 is used.

The following description will discuss these inversions with reference to FIGS. 14 and 15.

Each of FIGS. 14 and 15 is a structural diagram illustrating a structure of the scanning signal lines G, the data signal lines S, and the pixel electrodes of the display panel 2. (a) of each of FIGS. 14 and 15 illustrates polarities of voltages applied to the pixel electrodes in the n-th frame. (b) of each of FIGS. 14 and 15 illustrates polarities of voltages which are applied to the pixel electrodes in a subsequent frame (the (n+1)-th frame) and are reverse in polarity to the voltages applied in the n-th frame. The polarities of the voltages applied to the pixel electrodes are indicated by + (plus) and − (minus) shown in each of FIGS. 14 and 15.

(a) of FIG. 14 illustrates an example of the source inversion. According to the source inversion, polarities of voltages to be applied are reversed for each of the data signal lines (source lines) S. This makes it possible to reverse the polarities of the voltages for every pixel electrodes arranged in the direction in which the scanning signal lines G extend (see (a) of FIG. 14).

(b) of FIG. 14 also illustrates the source inversion identical to that illustrated in (a) of FIG. 14. However, (b) of FIG. 14 is different from (a) of FIG. 14 in arrangement of the pixel electrodes. According to (a) of FIG. 14, pixel electrodes connected to each of the data signal lines S are provided on one side of the each of the data signal lines S (on the right side in the example illustrated in (a) of FIG. 14). In contrast, according to (b) of FIG. 14, the pixel electrodes connected to each of the data signal lines S are provided in a zigzag pattern with respect to the each of the data signal lines S. Therefore, the polarities of the voltages applied to pixel electrodes provided between adjacent ones of the data signal lines S are identical in the case of the arrangement illustrated in (a) of FIG. 14. However, the polarities of the voltages applied to the pixel electrodes provided between adjacent ones of the data signal lines S alternate in the case of the arrangement illustrated in (b) of FIG. 14.

(a) of FIG. 15 illustrates an example of the line inversion. According to the line inversion, polarities of voltages applied to the data signal lines S are reversed for each of the scanning signal lines G to be driven (for each of horizontal scanning periods). This makes it possible to reverse the polarities of the voltages for every pixel electrodes arranged in the direction in which the data signal lines S extend.

(b) of FIG. 15 illustrates an example of the dot inversion. The dot inversion can be carried out by combining the source inversion illustrated in (a) of FIG. 14 and the line inversion illustrated in (a) of FIG. 15. Specifically, when the first scanning signal line G1 is driven, a voltage applied to the first data signal line S is set to have a plus (+) polarity, and then polarities of voltages applied to the second and later data signal lines S are sequentially reversed. Next, when the second scanning signal line G2 is driven, a voltage applied to the first data signal line S is set to have a minus (−) polarity, and then polarities of voltages applied to the second and later data signal lines S are sequentially reversed. In a case where such a dot inversion is similarly repeated also when the third and later scanning signal lines G are driven, polarities of voltages applied to pixel electrodes adjacent to each other in the direction in which the scanning signal lines G extend and in the direction in which the data signal lines S extend can be different from each other (see (b) of FIG. 15).

Other Embodiments

In each of the embodiments described above, it is preferable that a transistor of the display panel 2 be a TFT having a semiconductor layer made from what is called "an oxide semiconductor." Examples of the oxide semiconductor include IGZO (InGaZnOx). FIG. 17 shows respective characteristics of a TFT made from the oxide semiconductor, a TFT made from a-Si (amorphous silicon), and a TFT made from LTPS (Low Temperature Poly Silicon). In FIG. 17, a horizontal axis (Vg) indicates a gate voltage supplied to each of the TFTs, and a vertical axis (Id) indicates an electric current between a source and a drain of each of the TFTs. Further, in FIG. 17, a period indicated as "TFT-on" is a period during which the TFTs are in an on-state, and a period indicated as "TFT-off" is a period during which the TFTs are in an off-state.

As shown in FIG. 17, in an on-state, a value of the electric current (i.e., electron mobility) of the TFT made from the oxide semiconductor is greater than that of the TFT made from a-Si. Specifically, although not shown in FIG. 17, the TFT made from a-Si has an electric current Id of 1 uA in an on-state (at "TFT-on"), whereas the TFT made from the oxide semiconductor has an electric current Id of 20 uA to 50 uA at TFT-on. This shows that, in an on-state, the value of the electric current (electron mobility) of the TFT made from the oxide semiconductor is 20 to 50 times greater than that of the TFT made from a-Si. The TFT made from the oxide semiconductor thus has an excellent ON characteristic.

As described above, in a case where, in each of the embodiments, the TFT made from the oxide semiconductor is used for each of the pixels as the transistor of the display panel 2, the TFT of the each of the pixels has an excellent ON characteristic. This increases electron mobility at the time of writing pixel data to each of the pixels. Accordingly, time required to write the pixel data to each of the pixels can be further reduced.

In the display device according to the embodiment of the present invention, the following formula is preferably met where Td is a length of the scanning period and Ts is a sum of a length of the pause period set to the preceding frame and a length of the pause period set to the subsequent frame.

$$Td \leq (1/2) \cdot Ts \quad \text{[Math 7]}$$

This makes it possible to reduce electric power consumption of the display device more effectively.

In the display device according to the embodiment of the present invention, the following formula is preferably met.

$$1/(Td+Ts) \geq 40 \text{ Hz} \quad \text{[Math 8]}$$

This makes it possible to reduce a luminance gradient by a state in which flickering is sufficiently suppressed in the display device.

In the display device according to the embodiment of the present invention, a polarity of a voltage of a data signal supplied to the display panel is preferably reversed for each scanning period.

This makes it possible, also in what is called "source inversion driving," to (i) reduce electric power consumption of the display device significantly and (ii) prevent degradation of display quality caused by generation of a luminance gradient.

In the display device according to the embodiment of the present invention, a pause period is preferably set to an entire period of each of a plurality of consecutive frames which follow the subsequent frame.

This makes it possible, also in a case where a plurality of frames, to each of which a pause period is set, occur in succession, to (i) reduce electric power consumption of the display device significantly and (ii) prevent degradation of display quality caused by generation of a luminance gradient.

It is preferable that the display device according to the embodiment of the present invention further includes a memory in which a video signal supplied from outside the display device is tentatively stored.

According to this, a video signal is transmitted from the main device, which is provided outside the display device, to, for example, the timing controller of the display device. In this case, when the main device transmits a video signal to the timing controller, the main device, owing to the provision of the memory, does not have to convert the video signal into a signal having a speed in accordance with scanning carried out by the display device.

Accordingly, the main device can use the same circuit configuration as that in a conventional technique, without the need to include a special circuit which is separately provided in accordance with a speed of the scanning carried out by the display device.

It is preferable that the display device according to the embodiment of the present invention be a liquid crystal display device.

This makes it possible to provide a liquid crystal display device which enables reducing electric power consumption and prevent degradation of display quality caused by generation of a luminance gradient.

In the display device according to the embodiment of the present invention, it is preferable that (i) the display panel include a data signal line, a scanning signal line, a pixel electrode, and a transistor which is connected with the data signal line, the scanning signal line, and the pixel electrode and (ii) the transistor have a semiconductor layer which is made from an oxide semiconductor.

In the display device according to the embodiment of the present invention, it is preferable that the oxide semiconductor be IGZO.

The display device according to the embodiment of the present invention may include a liquid crystal display panel or an organic electroluminescent display panel so that the display device is provided as a liquid crystal display device or an organic EL display device.

The present invention is not limited to the above-described embodiments but allows various modifications within the scope of the claims. In other words, any embodiment derived from a combination of two or more technical means appropriately modified within the scope of the claims will also be included in the technical scope of the present invention.

INDUSTRIAL APPLICABILITY

A display device according to the present invention can be widely used as various display devices such as a liquid crystal display device, an organic EL display device, and an electronic paper.

REFERENCE SIGNS LIST

1: display device
2: display panel
4: scanning line drive circuit
6: signal line drive circuit
8: common electrode drive circuit
10: timing controller
12: control signal outputting section
14: power supply circuit
16: memory
G: scanning signal line
S: data signal line

The invention claimed is:

1. A display device comprising a display panel,
the display device repeating a scanning period during which the display panel is scanned and a pause period during which the display panel is not scanned, wherein:
a scanning period and a pause period are set successively to a preceding frame out of two consecutive frames; and
a pause period is set to an entire period of a subsequent frame out of the two consecutive frames; wherein
the following formula is true:

$$Td \leq (1/2) \cdot Ts$$

where Td is a length of the scanning period, and Ts is a sum of a length of the pause period set to the preceding frame and a length of the pause period set to the subsequent frame.

2. The display device as set forth in claim 1, wherein the following formula is also true:

$$1/(Td+Ts) \geq 40 \text{ Hz}.$$

3. The display device as set forth in claim 1, wherein:
a polarity of a voltage of a data signal supplied to the display panel is reversed for each scanning period.

4. The display device as set forth in claim 1, wherein:
a pause period is set to an entire period of each of a plurality of consecutive frames which follow the subsequent frame.

5. A display device as set forth in claim 1, further comprising a memory in which a video signal supplied from outside the display device is tentatively stored.

6. The display device as set forth in claim 1, wherein:
the display device is a liquid crystal display device.

7. The display device as set forth in claim 1, wherein:
the display panel includes a data signal line, a scanning signal line, a pixel electrode, and a transistor which is connected with the data signal line, the scanning signal line, and the pixel electrode; and
the transistor includes a semiconductor layer which is made from an oxide semiconductor.

8. The display device as set forth in claim 7, wherein:
the oxide semiconductor is IGZO.

9. The display device as set forth in claim 1, wherein:
the display panel is a liquid crystal display panel.

10. The display device as set forth in claim 1, wherein:
the display panel is an organic electroluminescent display panel.

11. A method for driving a display device which includes a display panel and repeats a scanning period during which the display panel is scanned and a pause period during which the display panel is not scanned,
the method comprising:
setting a scanning period and a pause period successively to a preceding frame out of two consecutive frames; and
setting a pause period to an entire period of a subsequent frame out of the two consecutive frames; wherein
the following formula is true:

$$Td \leq (1/2) \cdot Ts$$

where Td is a length of the scanning period, and Ts is a sum of a length of the pause period set to the preceding frame and a length of the pause period set to the subsequent frame.

12. A display device comprising a display panel,
the display device repeating a scanning period during which the display panel is scanned and a pause period during which the display panel is not scanned, wherein:
a scanning period and a pause period are set successively to a preceding frame out of two consecutive frames; and
a pause period is set to an entire period of a subsequent frame out of the two consecutive frames; wherein
the following formula is true:

$$1/(Td+Ts) \geq 40 \text{ Hz}$$

where Td is a length of the scanning period, and Ts is a sum of a length of the pause period set to the preceding frame and a length of the pause period set to the subsequent frame.

13. The display device as set forth in claim 12, wherein:
a polarity of a voltage of a data signal supplied to the display panel is reversed for each scanning period.

14. The display device as set forth in claim 12, wherein:
a pause period is set to an entire period of each of a plurality of consecutive frames which follow the subsequent frame.

15. A display device as set forth in claim 12, further comprising a memory in which a video signal supplied from outside the display device is tentatively stored.

16. The display device as set forth in claim 12, wherein:
the display device is a liquid crystal display device.

17. The display device as set forth in claim 12, wherein:
the display panel includes a data signal line, a scanning signal line, a pixel electrode, and a transistor which is connected with the data signal line, the scanning signal line, and the pixel electrode; and
the transistor includes a semiconductor layer which is made from an oxide semiconductor.

18. The display device as set forth in claim 17, wherein:
the oxide semiconductor is IGZO.

19. The display device as set forth in claim 12, wherein:
the display panel is a liquid crystal display panel.

20. The display device as set forth in claim 12, wherein:
the display panel is an organic electroluminescent display panel.

* * * * *